US005695451A

United States Patent [19]

Kawakami

[11] Patent Number: 5,695,451

[45] Date of Patent: Dec. 9, 1997

[54] MASSAGING APPARATUS

[75] Inventor: Hisatomi Kawakami, Tokyo, Japan

[73] Assignee: Tetsuhiro Kawakami, Tokyo, Japan

[21] Appl. No.: 311,558

[22] Filed: Sep. 23, 1994

[30] Foreign Application Priority Data

| | | | |
|---|---|---|---|
| Sep. 28, 1993 | [JP] | Japan | 5-264388 |
| Nov. 10, 1993 | [JP] | Japan | 5-304739 |
| Mar. 17, 1994 | [JP] | Japan | 6-072755 |
| Mar. 18, 1994 | [JP] | Japan | 6-074169 |
| May 24, 1994 | [JP] | Japan | 6-133604 |

[51] Int. Cl.[6] ..... A61H 7/00

[52] U.S. Cl. ..... 601/84; 601/86; 601/87; 601/134

[58] Field of Search ..... 601/134, 84, 98, 601/85–7, 97–101

[56] References Cited

U.S. PATENT DOCUMENTS

| | | | |
|---|---|---|---|
| 2,914,065 | 11/1959 | Cory | 128/45 |
| 3,103,925 | 9/1963 | Vogt | 601/134 |
| 3,699,952 | 10/1972 | Waters et al. | 601/18 |
| 3,984,101 | 10/1976 | Garza | 601/26 X |
| 4,061,137 | 12/1977 | Sandt | 128/33 |
| 5,065,743 | 11/1991 | Sutherland | 601/134 |
| 5,137,015 | 8/1992 | Anglehart | 601/98 |
| 5,203,321 | 4/1993 | Donovan et al. | 601/5 |
| 5,233,973 | 8/1993 | Gill et al . | 601/99 X |
| 5,356,369 | 10/1994 | Yamasaki | 601/134 |

FOREIGN PATENT DOCUMENTS

| | | | |
|---|---|---|---|
| 380395 | 10/1985 | Austria . | |
| 2713438 | 9/1978 | Germany . | |
| 9208487 | 11/1992 | Germany . | |
| 125952 | 5/1994 | Japan | 601/98 |
| 1692578 | 11/1991 | Russian Federation | 601/98 |
| 639268 | 11/1983 | Switzerland . | |
| 531088 | 12/1940 | United Kingdom . | |

*Primary Examiner*—Danton D. DeMille
*Attorney, Agent, or Firm*—Robert W. J. Usher

[57] ABSTRACT

A massaging apparatus with a massaging mechanism comprises at least one pressing member for pressing against a specific location of a body portion, and an unit for moving the pressing member transversely across the specific location while the pressing member is pressed against the specific location. The massaging apparatus may further include a support body for pressing the body portion. At least one massaging opening is formed in the support body for alignment with the specific location of a body portion placed on the support body. The massaging mechanism is provided inside the support body so that an upper end of the pressing member is projecting outward through the massaging opening. When the body portion is placed on the support body, the specific location of the body portion is pressed and massaged by the pressing member while the pressing member is transversely moved.

18 Claims, 39 Drawing Sheets

MASSAGING APPARATUS

BACKGROUND OF THE INVENTION

1. Field of the Invention

The invention relates to an apparatus for massaging a specific portion of a human body to relieve fatigue or stiffness of the body portion.

2. Relating Prior Art

Massaging apparatuses or machines to relieve a stiffness in a specific portion of a body (such as in the shoulder, the neck etc.) are well known and in widespread practical use. The massaging apparatus typically give a massage by tapping or vibrating the specific body portion.

For example, an apparatus for tapping on the shoulder, an apparatus with a vibrator to vibrate on the body portion, an apparatus with a pair of arms to grasp and massage a body portion, and an apparatus with rollers which are pushed on a body portion and moved along the body are all known.

The applicant of the present invention has a long experience in massaging the human body and found that the most effective way for massaging human body is to press a fingertip against a specific body portion and to move transversely the pressed fingertip on the body portion. Typically, the fingertip can be transversely moved so as to describe a circle locus, an ellipse locus or a locus of a figure "8".

The movement of the fingertip so as to describe an ellipse locus is experientially found to be particularly effective for relieving stiffness and fatigue of the human body.

SUMMARY OF THE INVENTION

It is an object of the invention to provide a massaging apparatus which enables a massage very similar to a massage by pressing a fingertip against a specific body portion and moving the pressed fingertip transversely on the specific body portion.

It is an another object of the invention to provide a massaging apparatus which enables a massage very similar to a massage by pressing a fingertip against a specific body portion and moving the pressed fingertip transversely so as to describe an ellipse locus on the specific body portion.

It is a still another object of the invention to provide a massaging apparatus which enables a massage very similar to a massage by pressing a fingertip against a specific body portion and moving the pressed fingertip transversely so as to describe a circle locus on the specific body portion.

It is a further object of the invention to provide a massaging apparatus which enables a massage very similar to a massage by pressing a fingertip against a specific body portion and moving the pressed fingertip transversely so as to describe a locus of a figure "8".

It is a still further object of the invention to provide a massaging apparatus which enables a massage very similar to a massage by pressing a fingertip against a specific body portion and moving the pressed fingertip transversely to as to selectively describe a circle locus, an ellipse locus and a locus of a figure b "8".

It is an another object of the invention to provide a massaging apparatus which enables a massage very similar to a massage by pressing a fingertip against a specific body portion and moving the pressed fingertip transversely, and further which can control the speed of the transverse motions.

A massaging apparatus according to the present invention includes a massaging mechanism. The massaging mechanism comprises at least one pressing member for pressing against a specific location of a body portion, and means for moving the pressing member transversely across the specific location while the pressing member is pressed against the specific location.

The massaging apparatus may further include a support body for supporting the body portion. At least one massaging opening is formed in the support body for alignment with the specific location of a body portion placed on the support body. The massaging mechanism is provided inside the support body so that an upper end of the at least one pressing member is projecting outward through the massaging opening. When the body portion is placed on the support body, the specific location of the body portion is pressed and massaged by the pressing member while the pressing member is transversely moved by the transverse moving means.

The amount of outward projection of the pressing member through the massaging opening can be adjusted to adjust a pressing force applied by the pressing member against the specific location.

A plurality of the pressing members may be provided so as to project through the massaging opening. The respective pressing members may be moved transversely by the transverse moving means.

The support body may defines a neck or a waist supporting portion by which a neck portion or a waist portion of the body can be supported.

A pair of the massaging openings may be formed in the support body, and a pair of the massaging mechanisms may be mounted in the support body with respective pressing members threrof projecting outward through the respective massaging openings. The transverse movements of the pressing members by the transverse moving means can be independently controlled.

The transverse moving means may include a elliptical motion producing mechanism for moving the pressing member transversely describing an ellipse locus.

The elliptical producing motion mechanism may comprise a base, a rotational member support swingably mounted on the base, a cam member rotatively mounted on the rotational member support and connected to the pressing member, a cam follower fixed to the base, and a rotational drive device by which the cam member is rotated. The rotational axis of the cam member is eccentric from the axis of the pressing member. The cam follower has an internal cam contact surface with which the cam member is kept in contact. When the cam member is rotated by the rotational drive device, the rotational member support is swung back and forth reciprocatingly with respect to the base and the pressing member is rotated about the rotational axis of the cam member so that the pressing member describes substantially an ellipse locus.

The elliptical motion producing mechanism may comprise a base, a rotational member support swingably mounted on the base, a rotational member rotatively mounted on the rotational member support and connected to the pressing member, a cam member rotatively mounted on the rotational member support, a cam follower fixed to the base, a biassing means urging the cam member toward the cam follower, and a rotational drive device for rotating the rotational member and the cam member so that rotation of the rotational axis of the rotational member is eccentric from the axis of the pressing member. The cam follower has an external cam contact surface with which the cam member comes in contact. Since the cam member is urged toward the cam follower by the biassing means, the cam member is kept in contact with the cam contact surface. When the rotational member and the cam member are rotated by the rotational drive device, the rotational member support is swung back and forth repeatedly with respect to the base and rotates the pressing member around the rotational axis of the cam member so that the pressing member describes substantially an ellipse locus.

The transverse moving means may comprise a rotational member connected to the pressing member, the rotational axis of the rotational member being eccentric from a rotational axis of the pressing member, a rotational drive device for rotating the rotational member about its rotational axis, and a reciprocating member mounted for back and forth movement. The rotational drive device is mounted on the reciprocating member. A reciprocating drive device for moving the reciprocating member back and forth is also included in the transverse moving means.

The transverse moving means may comprise a rotational member connected to the pressing member, the rotational axis of the rotational member being eccentric from the axis of the pressing member, a rotational drive device for rotating the rotational member about its rotational axis, and a swingable member on which the rotational drive device is mounted. The swingable member is pivotally mounted on the support body so as to swing back and forth. A swing drive device to swing the swing member back and forth around a pivot axle with respect to the support body is also included.

The operations of the rotational drive device and the reciprocating drive device (or the swing drive device) can be controlled by a controller to move the pressing member transversely.

The rotational drive device and the reciprocating drive device (or the swing drive device) may be synchronously driven at the same speed by the controller so that the movement of the pressing member describes an ellipse locus. They may be driven at a speed ratio of 2:1 by the controller so that the movement of the pressing member describes a locus of figure "8".

Either a A-mode in which only the rotational drive device is operated, a B-mode in which both the rotational drive device and the reciprocating drive device (or the swing drive device) are operated, or a C-mode in which only the reciprocating drive device (or the swing drive device) is operated can be selected by the controller.

Either a continuous drive pattern, an intermittent drive pattern, a reversible drive pattern, or an intermittent-reversible drive pattern can also be selected by the controller.

BRIEF DESCRIPTION OF THE DRAWINGS

FIG. 48 is a front view to show how to use the massaging apparatuses.

DETAILED DESCRIPTION OF THE PREFERRED EMBODIMENTS

Figure 1:
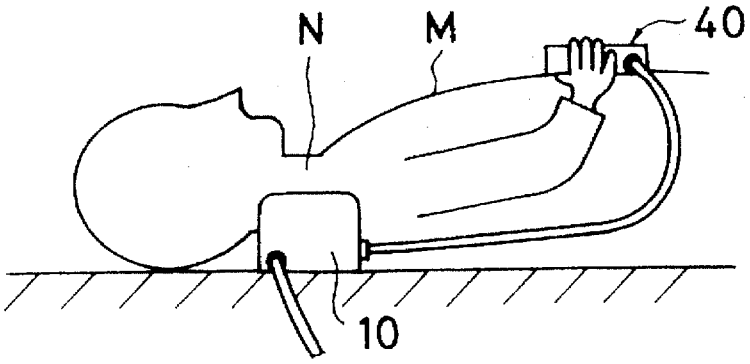
FIG. 1 is a side view of the massaging apparatus of the present invention illustrating the use thereof.
Figure 2:
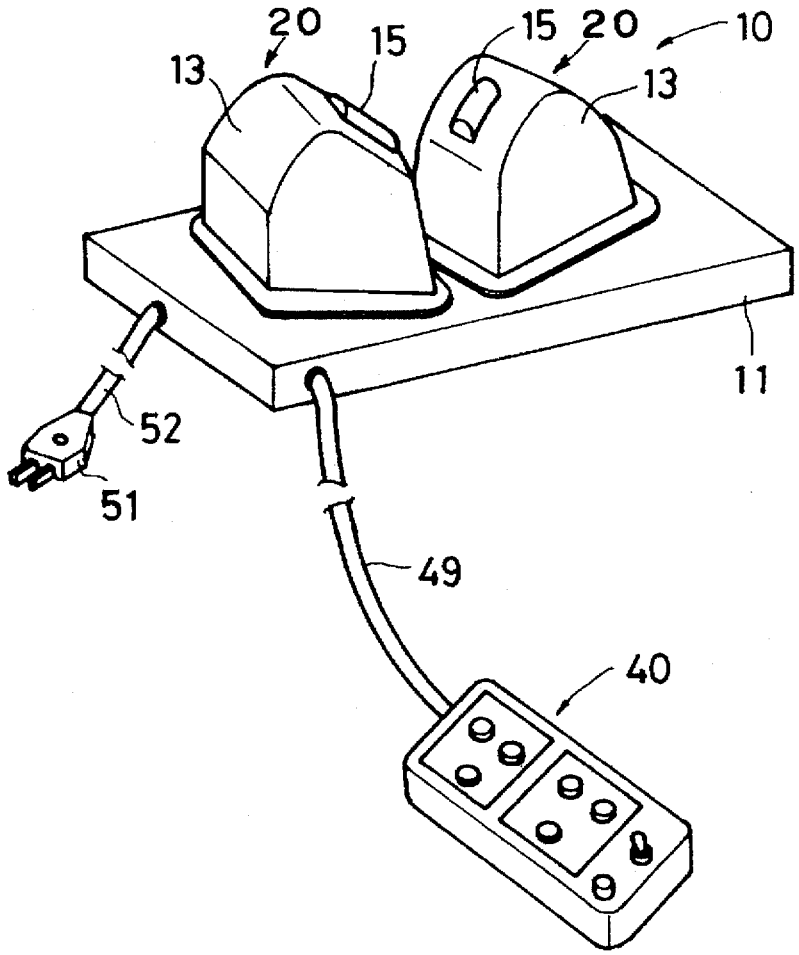
FIG. 2 is a perspective view of the massaging apparatus.
Figure 3:
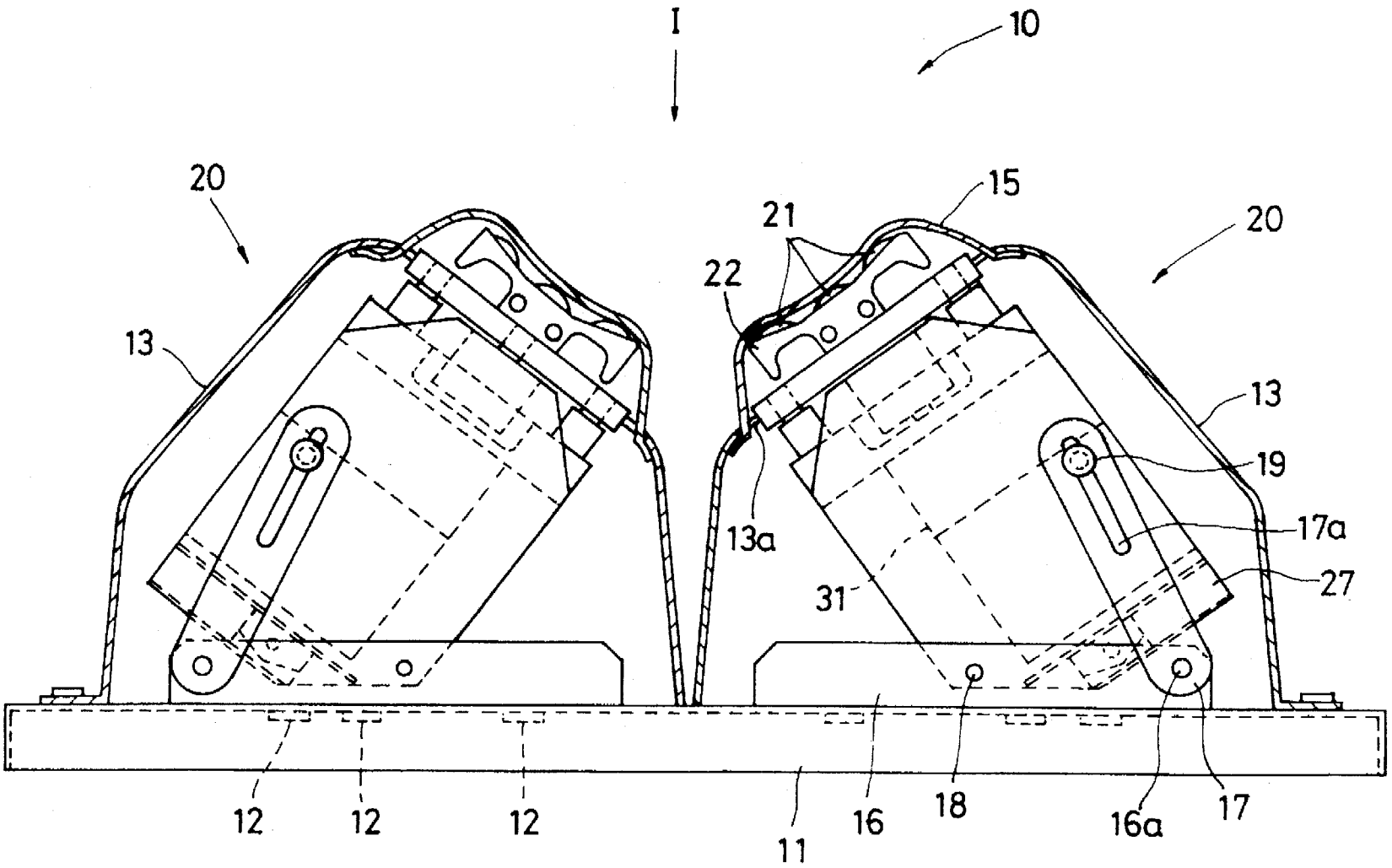
FIG. 3 is a front view, partially in cross-section, of the massaging apparatus shown in FIG. 2.

One example of a massaging apparatus 10 according to the present invention is shown in FIG. 1, FIG. 2 and FIG. 3. The massaging apparatus 10 is used to massage a neck portion N of a patient (human body) M. It comprises a support body 11 and a pair of massaging mechanisms 20,20 mounted on the support body 11 symmetrically.

Each massaging mechanism 20 has a pressing member 22 with a plurality of pressing bumps 21 and a mechanism cover 13 which covers the massaging mechanism 20. Since the right and left massaging mechanisms 20,20 have symmetrical structures, either one of the massaging mechanism 20 is described hereinafter.

A massaging opening 13*a* is formed on a slant top surface of the mechanism cover 13. Though the massaging mechanism 20 is covered by the mechanism cover 13 on the support body 11, the top portion of the pressing member 22 is protruded through the massaging opening 13*a*.

A cloth cover 15 is attached inside the mechanism cover 13 covering the massaging opening 13*a*, and accordingly the protruded portion of the pressing member 22 and the pressing bumps 21 are covered by the cloth cover 15.

Figure 5:
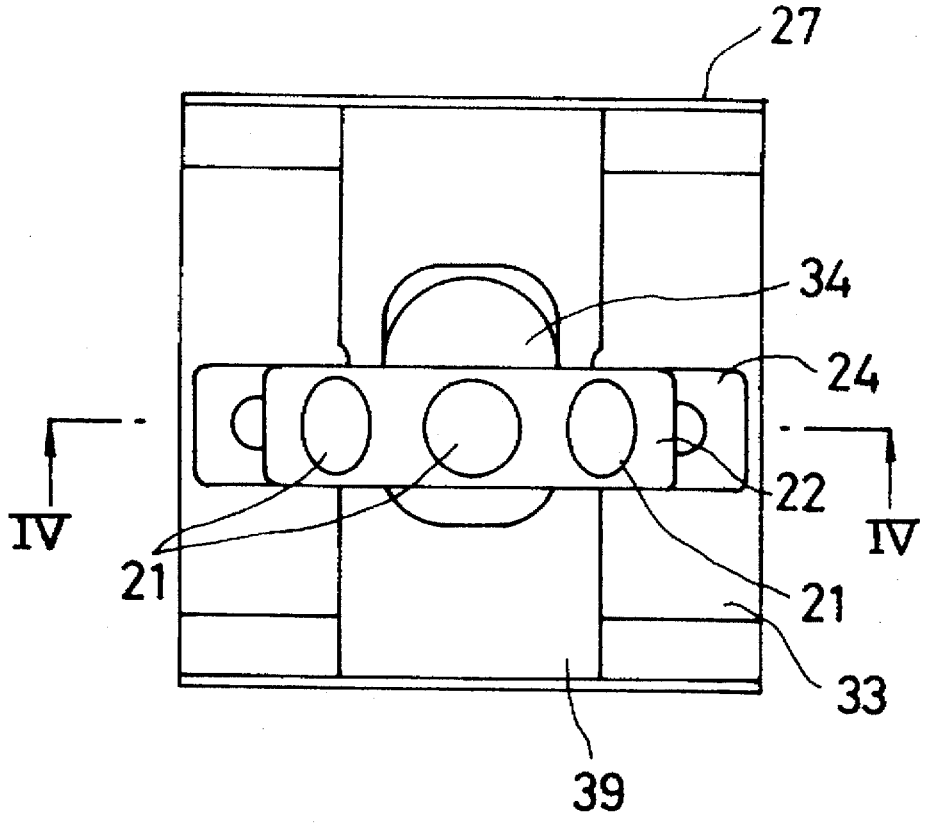
FIG. 5 is a top plan view of the massaging mechanism.
Figure 6:
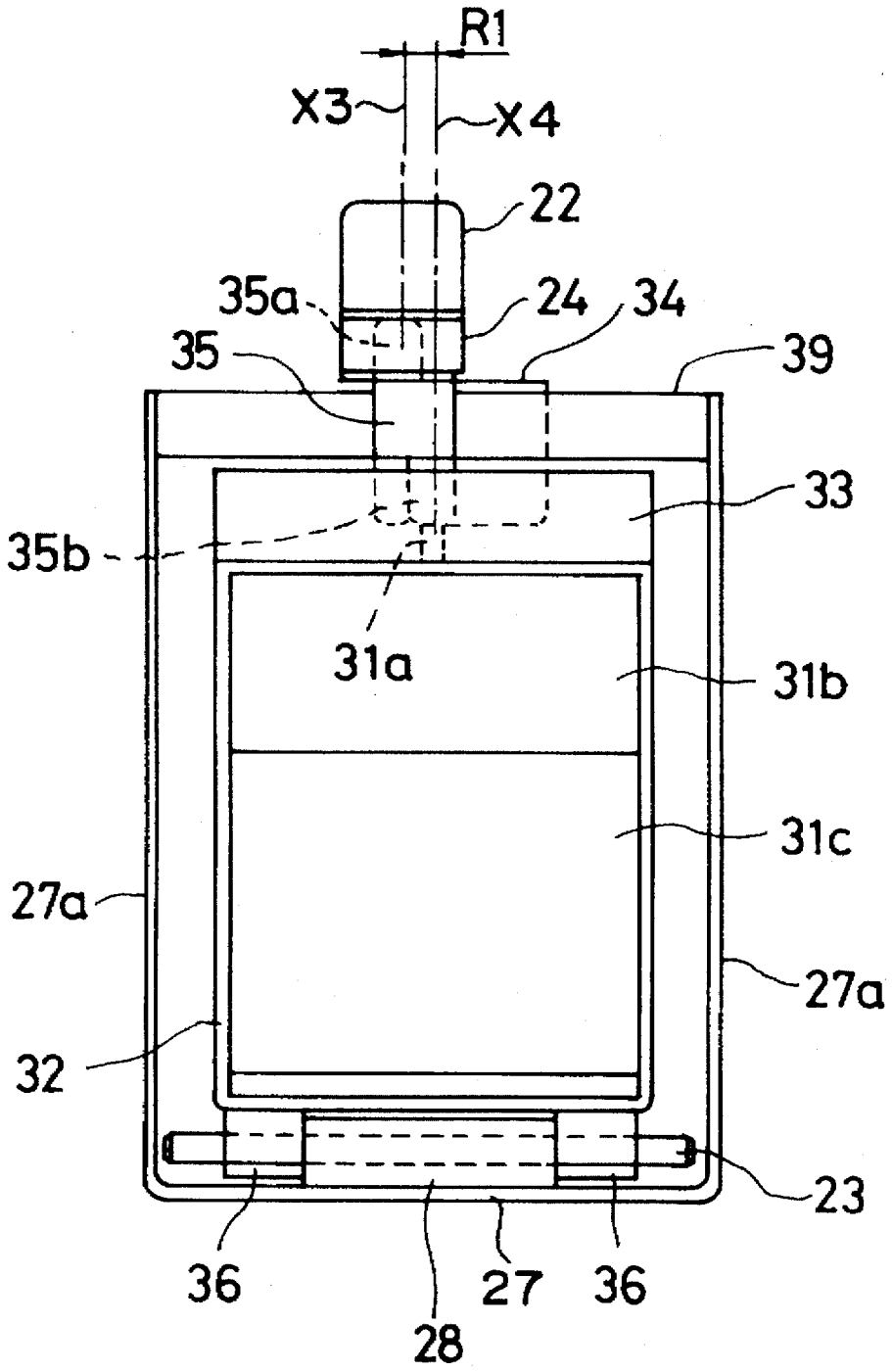
FIG. 6 is a side view of the massaging mechanism.

The massaging mechanism 20 is in detail described hereinafter further referring FIGS. 4–6. The massaging mechanism 20 basically comprises a base 27 and a rotational driving device 30 swingably mounted on the base 27.

The base 27 has a U-shape configuration with a pair of side plates 27*a*,27*b* extending vertically. A cam follower 39 is provided in the opening portion of the base 27 bridging the side plates 27*a*,27*b*. The cam follower 39 engages with a cylindrical boss (or a cam member) 34 to move the rotational driving device 30 swingably and reciprocatingly.

The rotational driving device 30 comprises a drive motor 31, a support frame 32, a motor support member 33, the boss 34 and a pair of crank members 35.

The support frame 32 has a U-shape construction in which the motor support member 33 is mounted. A pair of first swing axle support members 36 are mounted on the bottom lower surface of the support frame 32. A second swing axle support member 28 is mounted on the bottom upper surface of the base 27.

A swing axle 23 is mounted through holes formed on the first and second swing axle support members 36,28 to swingably mount the support frame 32 on the base 27.

The drive motor assembly 31 is mounted on the motor support member 33. A rotational axle 31*a* of the drive motor assembly 31 extends upward through a hole 33*a* formed in the motor support member 33. The drive motor assembly 31 comprises an electric motor 31*c* and a speed reduction gear device 31*b* having the rotational axle 31*a*. The rotational speed of the electric motor 31*c* can be controlled by a controller 40 (which will be described later) to drive the rotational axle at a desirable speed and torque.

Figure 7:
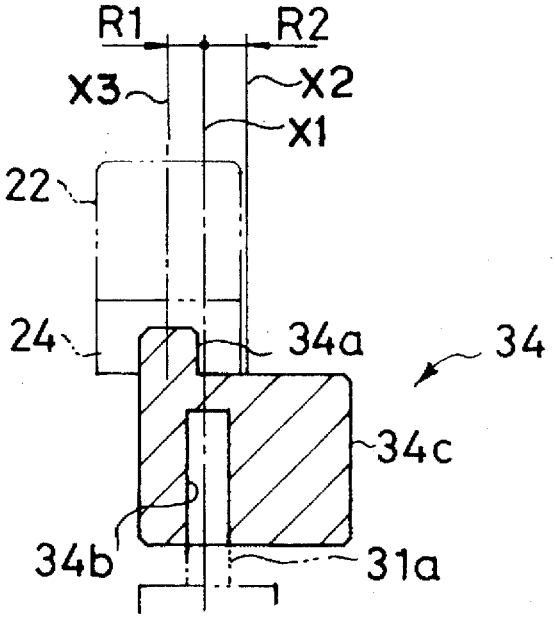
FIG. 7 is a cross-sectional view of the boss in the massaging mechanism.

The cylindrical boss 34 is tightly fitted to the rotational axle 31*a*. A support axle 34*a* is formed on the upper surface of the boss 34 as shown in FIG. 7. A axle insertion hole 34*b* is formed on the bottom surface of the boss 34. The center axis "Xi" of the axle insertion hole 34*b* is eccentric from the center axis "X2" of the cylindrical boss 34 by a distance "R2". Also, the center axis "X3" of the support axle 34*a* is eccentric from the center axis "Xi" of the axle insertion hole 34*b* by a distance "Ri" as shown in FIG. 7.

A pressing member support 24 on which the pressing member 22 is mounted is supported by the cylindrical boss 34. As shown in FIG. 4, a support hole 24*a* is formed on the central bottom surface of the pressing member support 24 in which the support axle 34*a* is loosely inserted. Two more support holes 24*b*,24*b* are also formed on the pressing member support 24 in which upper support axles 35*a*,35*a* of the crank member 35 are loosely inserted.

A lower support axle 35*b* formed on the bottom portion of the crank member 35 is loosely inserted into a support hole 33*d* to support the pressing member support 24 via the crank member 35. The center axis "X4" of the lower support axle 35*b* is eccentric from the center axis "X3" of the upper support axle 35*a* by a distance "Ri" as shown in FIG. 6.

Figure 8:
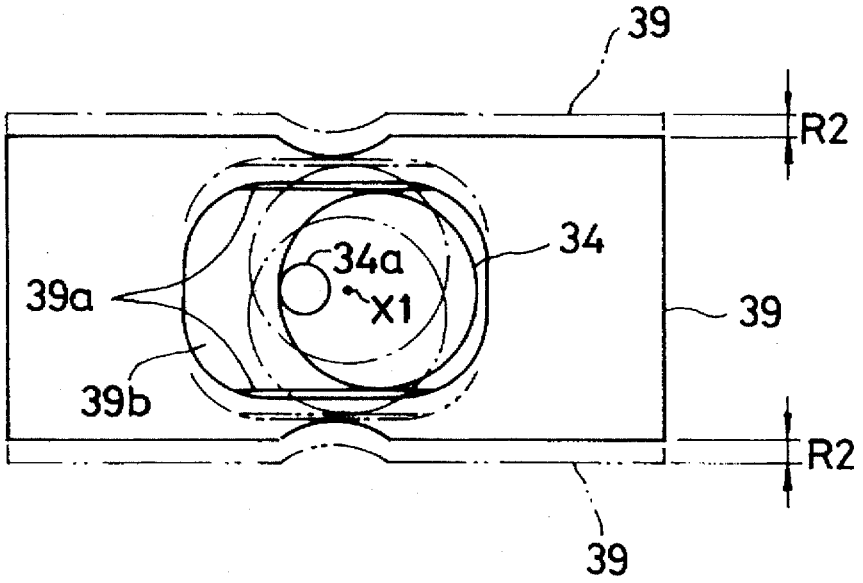
FIG. 8 is a top plan view of the boss and the cam follower.

The cylindrical boss 34 roles as a disc cam as shown in FIG. 8. When the drive motor assembly 31 is driven, the cylindrical boss 34 rotates around the axis "Xi".

A substantially rectangular opening 39*b* is formed in the cam follower 39. The cylindrical boss 34 is inserted into the opening 39*b* and an outer peripheral surface 34*c* of the cylindrical boss 34 comes in contact with side contact surfaces 39*a* of the opening 39*b*.

Figure 4:
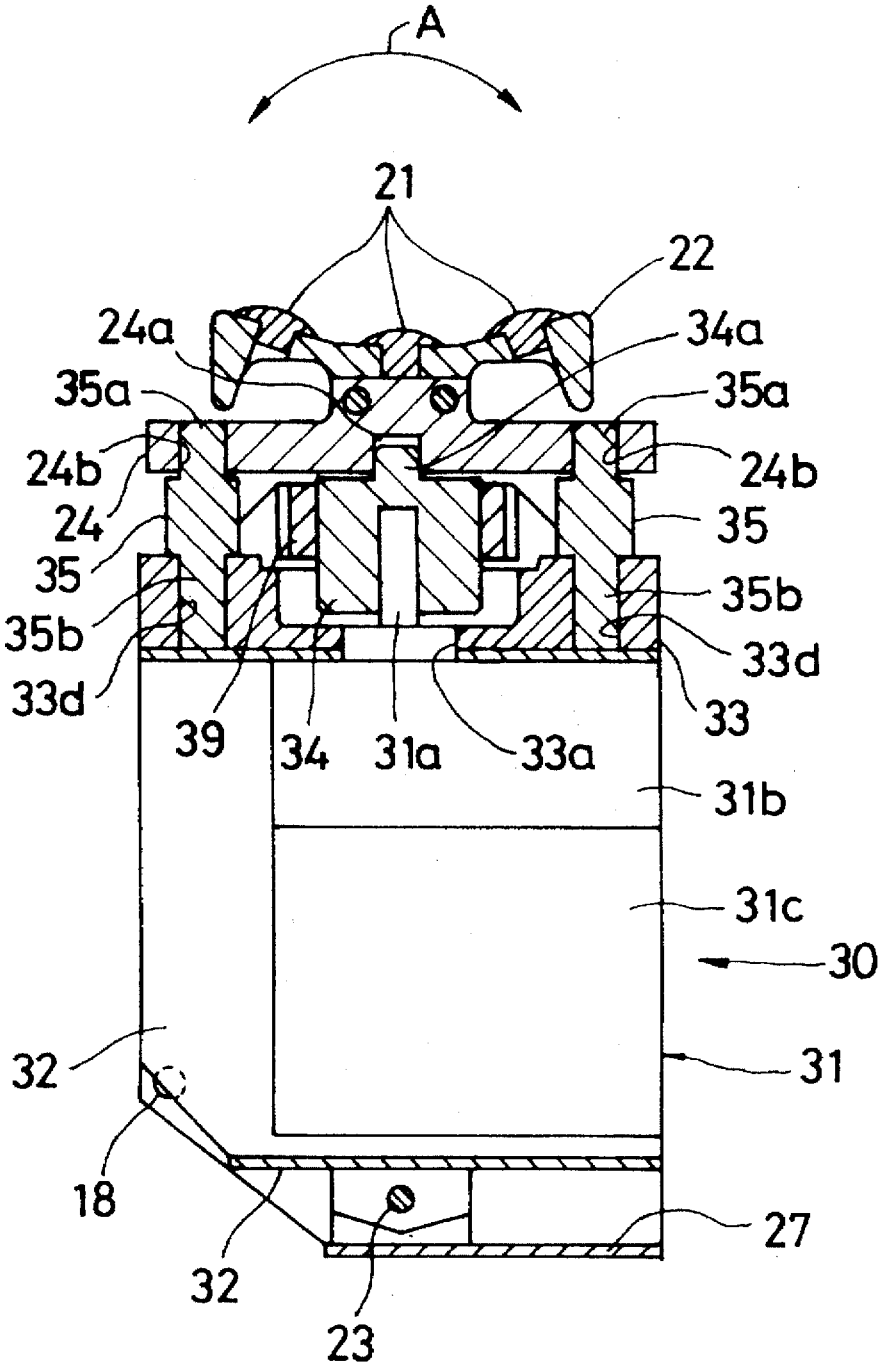
FIG. 4 is a cross-sectional view along the line IV—IV shown in FIG. 5.

The cylindrical boss 34 and the cam follower 39 are made of plastic materials having a low coefficient of friction and a high wear resistance (for example, polyacetal resin) to allow a smooth rotation of the cylindrical boss 34 keeping in contact with the side surfaces 39*a* of the cam follower As described above, since the rotational driving device 30 on which the cylindrical boss 34 is mounted is swingably supported by the base 27 on which the cam follower 39 is mounted, the rotational driving device 30 is swung back and forth as shown by an arrow A in FIG. 4 when the boss 34 is rotated. Namely, as shown by chain lines in FIG. 8, the rotational driving device 30 is moved reciprocatingly with an amplitude of "R2" in each side. For an easy understanding of the reciprocating motions, the relative motions of the cam follower 39 with respect to the rotational driving device 30 is shown in FIG. B, assuming that the rotational driving device 30 is held stationary, though the rotational driving device 30 is actually moved reciprocatively with respect to the fixed cam follower 39.

Since the pressing member support 24 is rotated around the axis "Xi" with a radius of "E1" by the drive motor 31, the pressing member 22 mounted on the pressing member support 24 is also rotated around the axis "XI". Accordingly, as a result of a combination of the rotational motion and the reciprocating swing motion, the pressing member 22 is moved so as to describe an ellipse locus.

The moving locus of the support axle 34*a* by which the elliptical motion of the pressing member 22 can be achieved is described referring to FIG. 9A–9D.

Figure 9A:
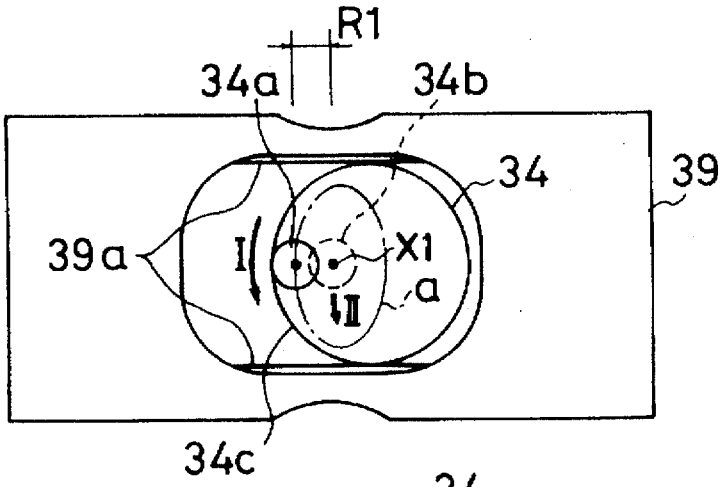
FIGS. 9A–9D are top plan views of the boss and the cam follower to illustrate the locus of the support axle.

As mentioned above, the outer peripheral surface 34*c* of the boss 34 is kept in contact with the side contact surfaces 39*a* in the cam follower 39. When the boss 34 is rotated around the axle insertion hole 34*b* in the direction shown by an arrow I (counter-clockwise direction) as shown in FIG. 9A, the contact surface (the outer peripheral surface 34*c*) is pushed by the side contact surfaces 39*a* of the cam follower. Since the cam follower 39 is fixedly mounted on the base 27, the support axle 34*a* and the axle insertion hole 34*b* is moved downward as shown by an arrow II.

Figure 9B:
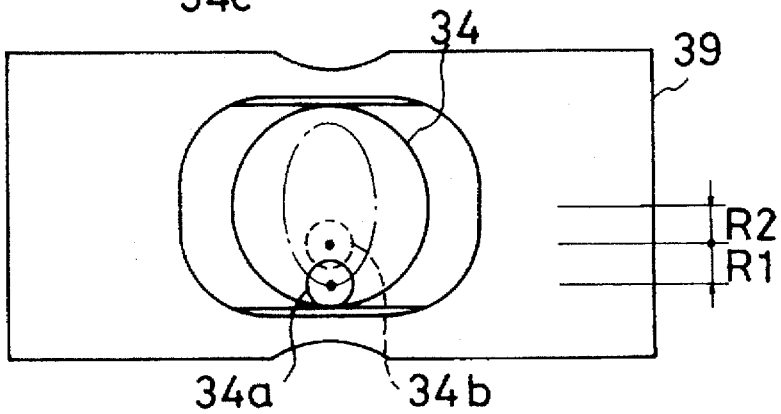
Figure 9C:
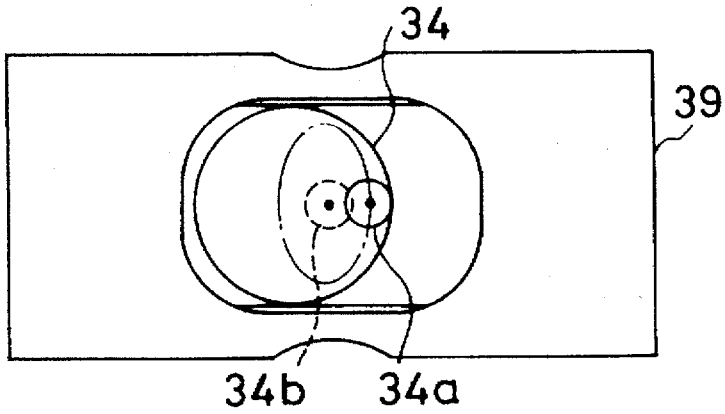
Figure 9D:
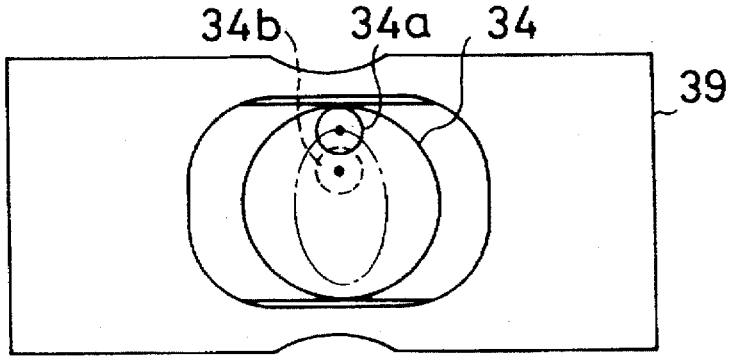

When the boss 34 is rotated counterclockwise by 90 degrees as shown in FIG. 9B, the support axle 34*a* is moved downward by a distance R2 while being rotated by 90 degrees around the axle insertion hole 34*b*. Accordingly, when the boss 34 is further rotated as shown in FIGS. 9C and 9D, the support axle 34*a* is moved along an ellipse locus as shown by a chain line.

As a result, the pressing member support 24 and the pressing member 22 mounted thereon are also moved along the ellipse locus. If the distance "R1" and "R2" are varied, the shape of the ellipse locus can be changed.

When another boss 34 on which a support axle 34*a* and an upper support axle 35*a* are differently located is used, the shape of the ellipse locus can be changed. Further, if the location of the axle insertion hole 34*b* is varied, the shape of the ellipse locus can also be changed.

Moreover, if the outer peripheral configuration of the boss 34 is differently shaped, the moving locus of the pressing member 22 can be changed.

Figure 10:
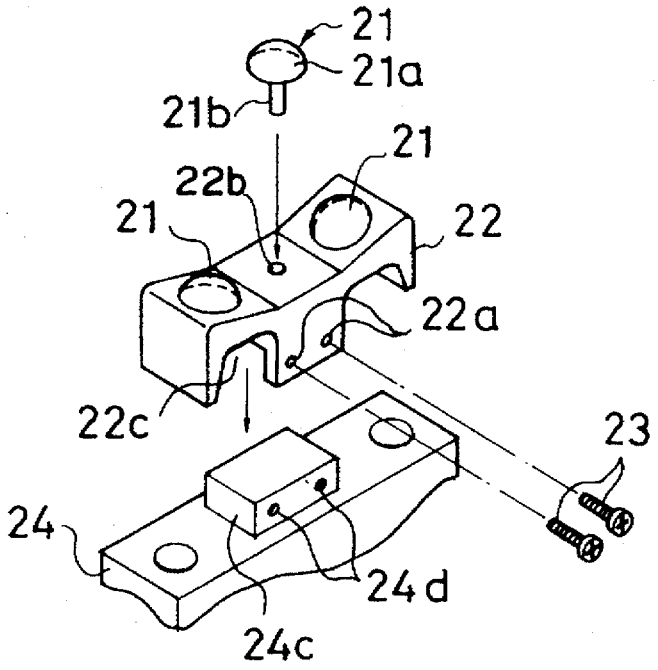
FIG. 10 is a perspective view of the pressing member.
Figure 11A:
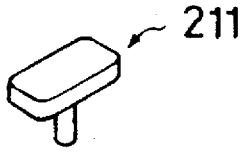
FIGS. 11A–11D are perspective views of the various pressing bumps.
Figure 11B:
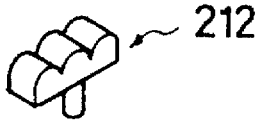
Figure 11C:
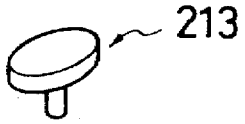
Figure 11D:
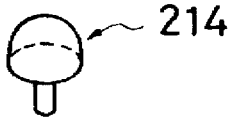
Figure 12A:
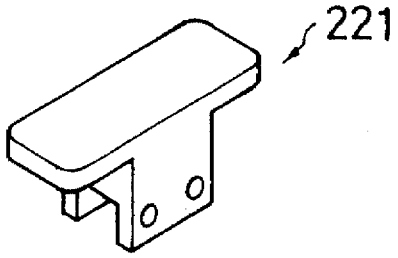
FIGS. 12A–12D and FIGS. 13A–13B are perspective views of the various pressing members.
Figure 12B:
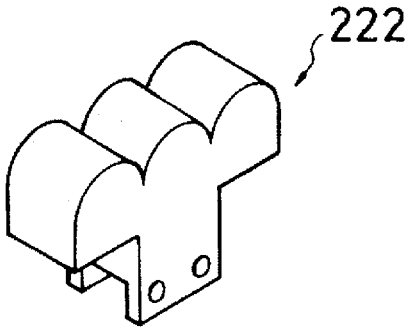
Figure 12C:
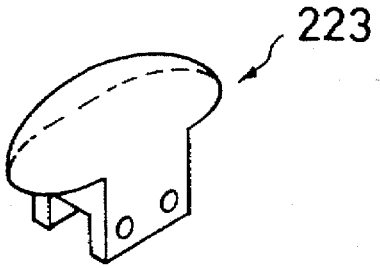
Figure 12D:
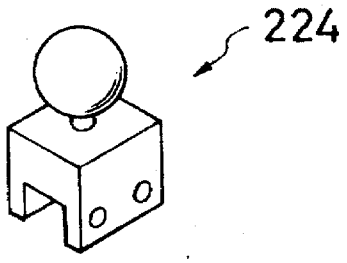

The pressing bumps 21 and the pressing member 22 are made of plastic materials having a low coefficient of friction and a high wear resistance. The pressing member 22 is formed so as to suitably fit with the massaging portion (e.g. neck portion N of a patient), and the three pressing bumps 21 are formed on the upper surface of the pressing member 22 as shown in FIG. 10. The pressing bump 21 respectively has a pressing portion 21*a* and a support pole 21*b*. It is attachably mounted on the pressing member 22 by tightly inserting the support pole 21*b* into the hole 22*b*.

The pressing member with the pressing bumps 21 is mounted on the pressing member support 24 by screws 23. It is mounted on the pressing member support 24 so as to cover a mounting portion 24*c*, and then is fastened by the screws 23 inserted into thread holes 24*d* through holes 22*a*.

Figure 13A:
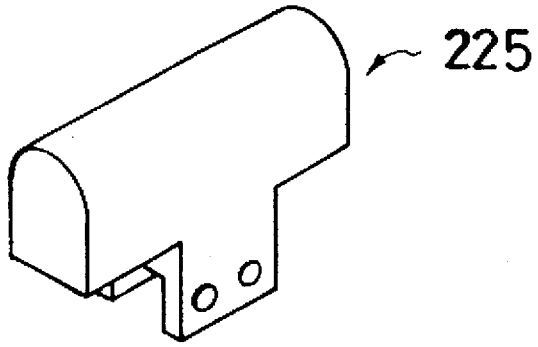
Figure 13B:
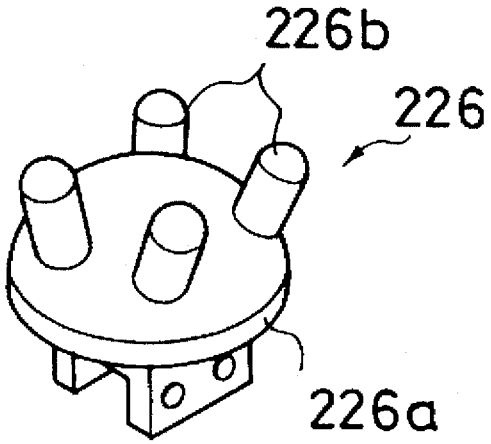

The pressing bumps can be formed as shown in FIGS. 11A–11D. Further, the pressing member and the pressing bumps can be made in one united body as shown in FIGS. 12A–12D and in FIGS.13A–13B.

As described above, the pressing member 22 is projecting outward through the massaging opening 13*a*. Therefore, when the pressing member 22 is moved transversely so as to describe the ellipse locus, the neck portion N of the patient M placed on the support body 11 as shown in FIG. 1 is massaged by the pressing member 22 (and the pressing bumps 21). Since the pressing member 22 and the pressing bumps 21 are made of plastic material with a low coefficient of friction, they can be moved smoothly against the cloth cover 15.

The electric motor 31*c* is driven by an electric power supplied through an electric wire 52 and a plug 51 plugged into an outlet. The operation of the electric motor 31*c* is controlled by a controller 40.

Figure 14:
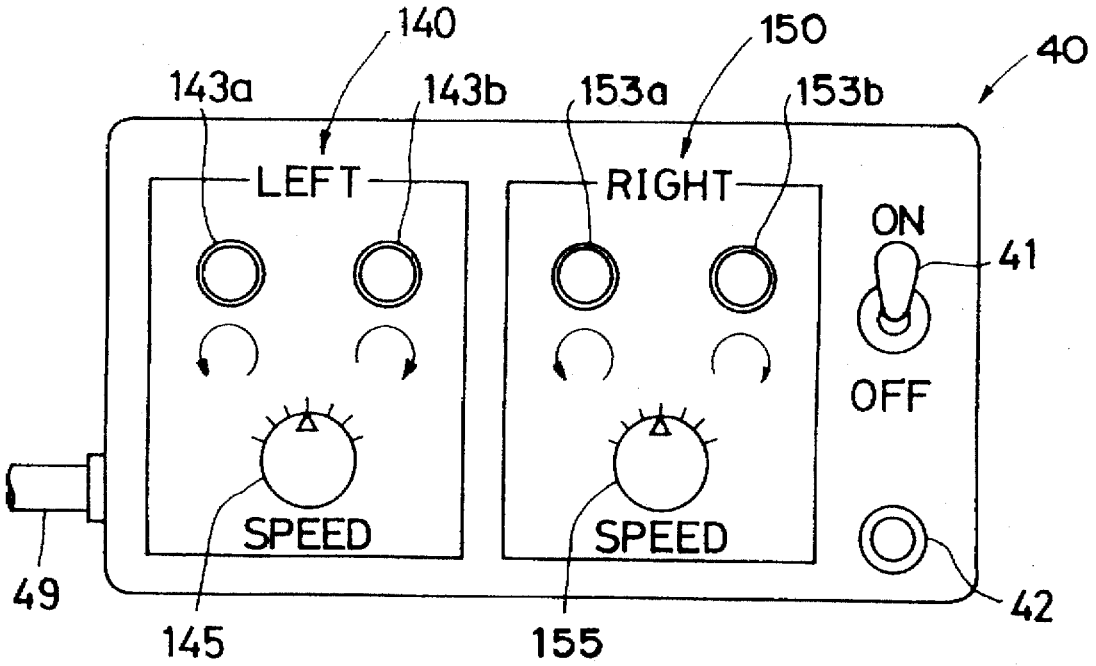
FIG. 14 is a top plan view of the controller.

The controller 40 comprises a remote control unit separately located from the support body 11 as shown in FIG. 2 and FIG. 14. The controller 40 is connected by a control wire 49 with the electric motor 31*c* in the support body 11.

As shown in FIG. 14, the controller 40 comprises a main switch 41, an operation indicating lamp 42, a left controlling unit 140 and a right controlling unit 150.

The main switch controls the electric power supply. When it is turned on, the electric power is supplied to the electric motor 31*c* through the electric wire 52 to drive the motor 31*c*. When it is turned on, the operation indicating lamp 42 is simultaneously turned on. The left and right controlling units 140,150 are respectively used to operationally control the left and right massaging mechanisms 20. Since the left and the right controlling units 140,150 have the same construction with each other, only the left unit 140 is described here.

The left controlling unit 140 comprises rotation change buttons 143*a*,143*b* and a speed control knob 145.

The rotation change buttons 143*a*,143*b* are used to change the rotational direction of the electric motor 31*c*. When the left rotation button 143*a* is pushed, the electric motor 31*c* is rotated so as to rotate the pressing member 22 counterclockwise. When the right rotation button 143*b* is pushed, the electric motor 31*c* is rotated so as to rotate the pressing member 22 clockwise.

The speed control knob 145 is used to control the rotational speed of the electric motor 31*c*. The further it is turned clockwise, the faster the electric motor 31*c* rotates to rotate the pressing member 22 faster.

Although the rotational change buttons and the speed change knobs are included in the controller 40, they are not always needed. A controller without these buttons and knobs can be used. Further, switches or buttons for continuously or intermittently operating the massaging mechanism can be included in the controller.

The massaging mechanism 20 as constructed above is swingably connected to a base plate 16, which is mounted on the support body 11, via pins 18 as shown in FIG. 3. It can be fixedly mounted by means of support poles 17. One end of the support pole 17 is connected to the base plate 16 by a pin 16*a* and the other end of the support pole 17 is connected to the base 27 by a screw 19. Since a slot 17*a* is formed on the support pole 17, the fixing location by the screw 19 can be adjusted so as to adjust the mounting angle of the massaging mechanism 20.

The massaging mechanism 20 is mounted on the support body 11 through the base plate 16 so as to be able to adjust horizontal location of the mechanism 20 with respect to the support body 11.

Figure 15:
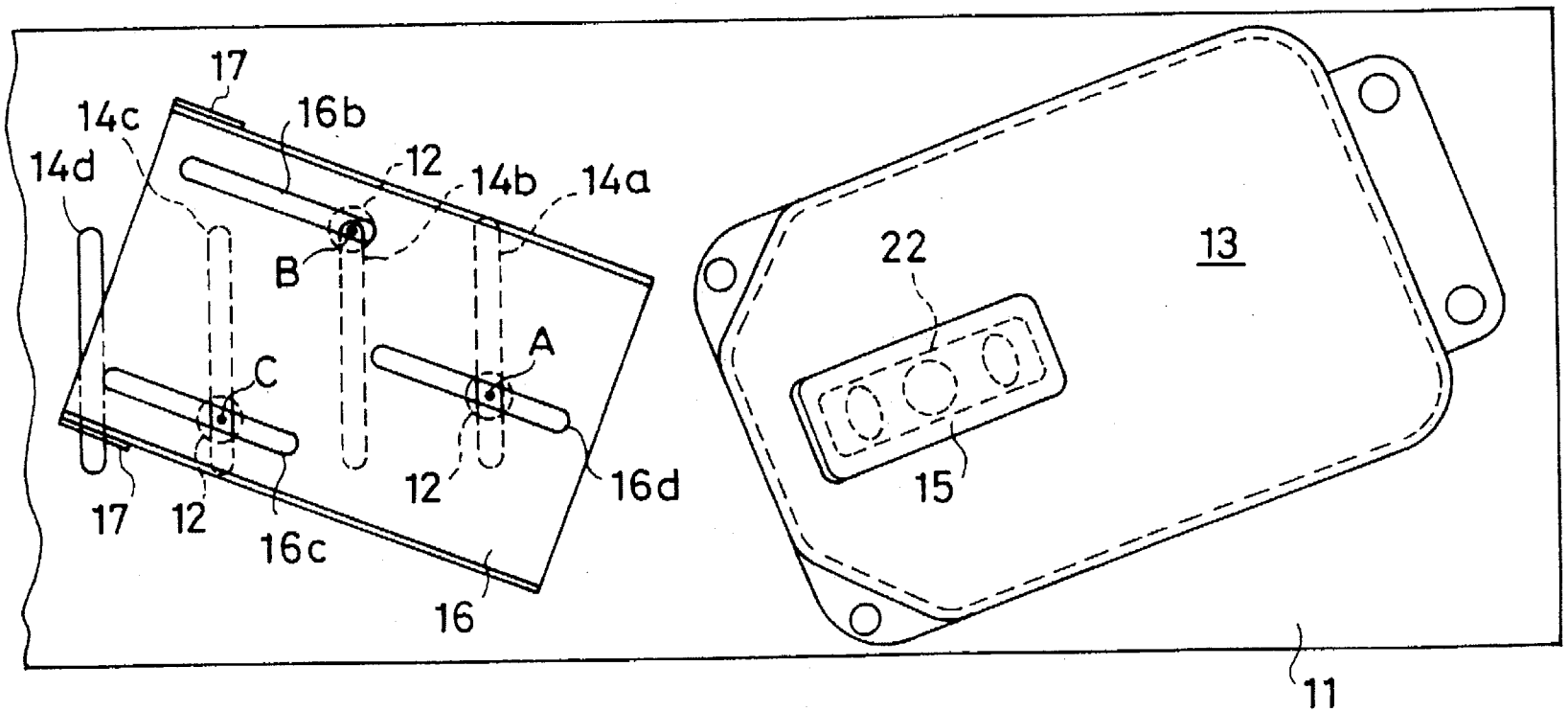
FIG. 15 is a plan view of the massaging apparatus with parts broken away to show the base parts.

In order to allow the horizontal adjustment, a plurality of slots 14*a*–14*d* are formed on the upper surface of the support body 11 and a plurality of slots 16*b*–16*d* are formed on the base plate 16 as shown in FIG. 15.

The base plate 16 by which the massaging mechanism 20 is supported is fixedly mounted on the support body 11 by means of screws 12 inserted through both the slots 14*a*–14*d* and 16*b*–16*d* so as to allow the horizontal adjustment.

As described above, the mounting angle of the massaging mechanism can be adjusted by the screw 19 and the horizontal mounting location can be adjusted by the screws 12.

Figure 16:
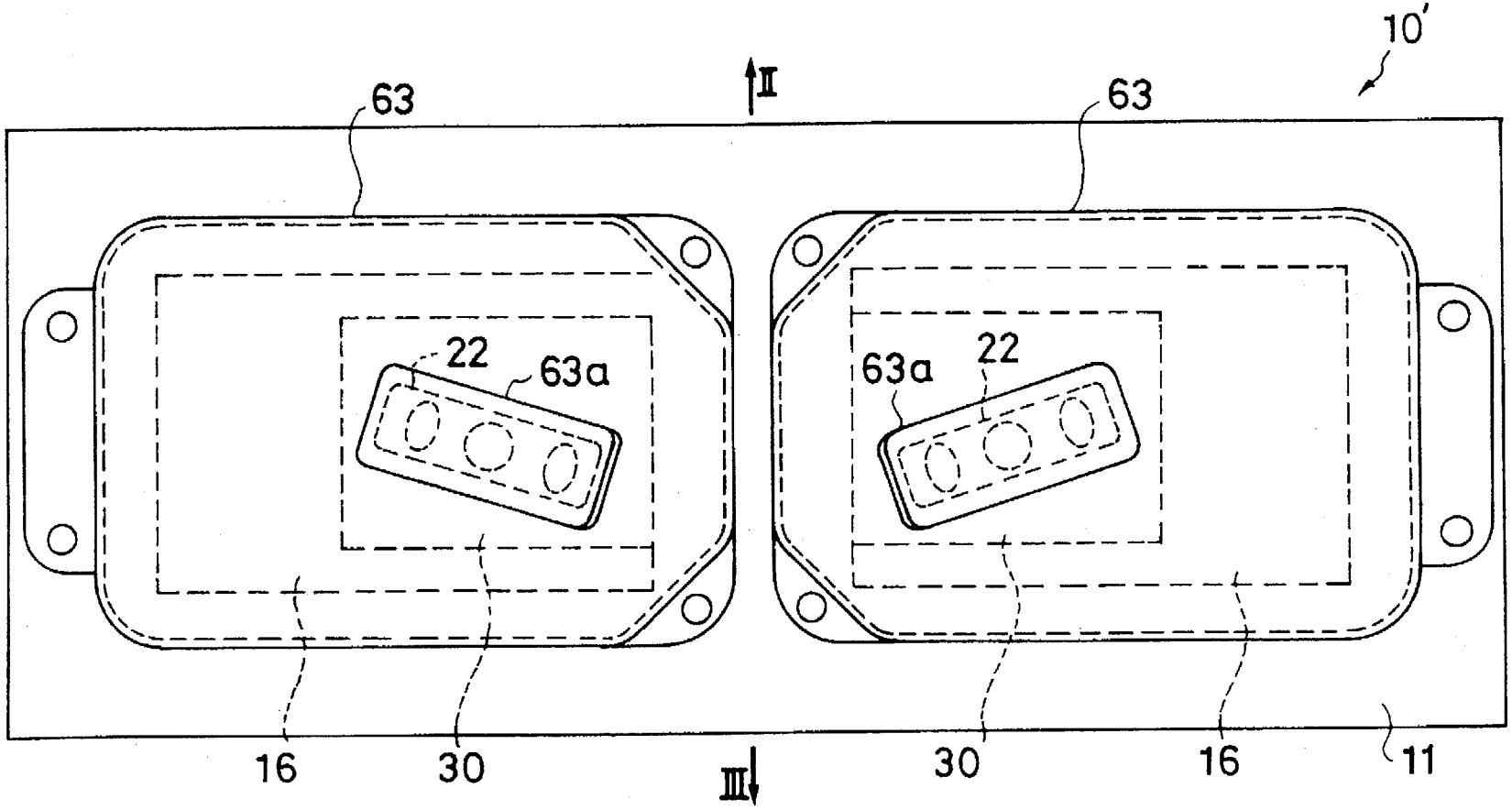
FIG. 16 is a top plan view of the massaging apparatus according to the second embodiment.

A massaging apparatus 10' according to a second embodiment of the present invention is shown in FIG. 16. In the apparatus 10', a pair of mechanism covers 63 is symmetrically mounted on the support body 11 in parallel. The rotational driving devices 30 and the base plates 16 are also symmetrically mounted on the support body 11 in parallel inside the covers 63. However, the massaging opening 63*a* is formed aslant to put the pressing member 22 aslant as shown in FIG. 16.

Figure 17:
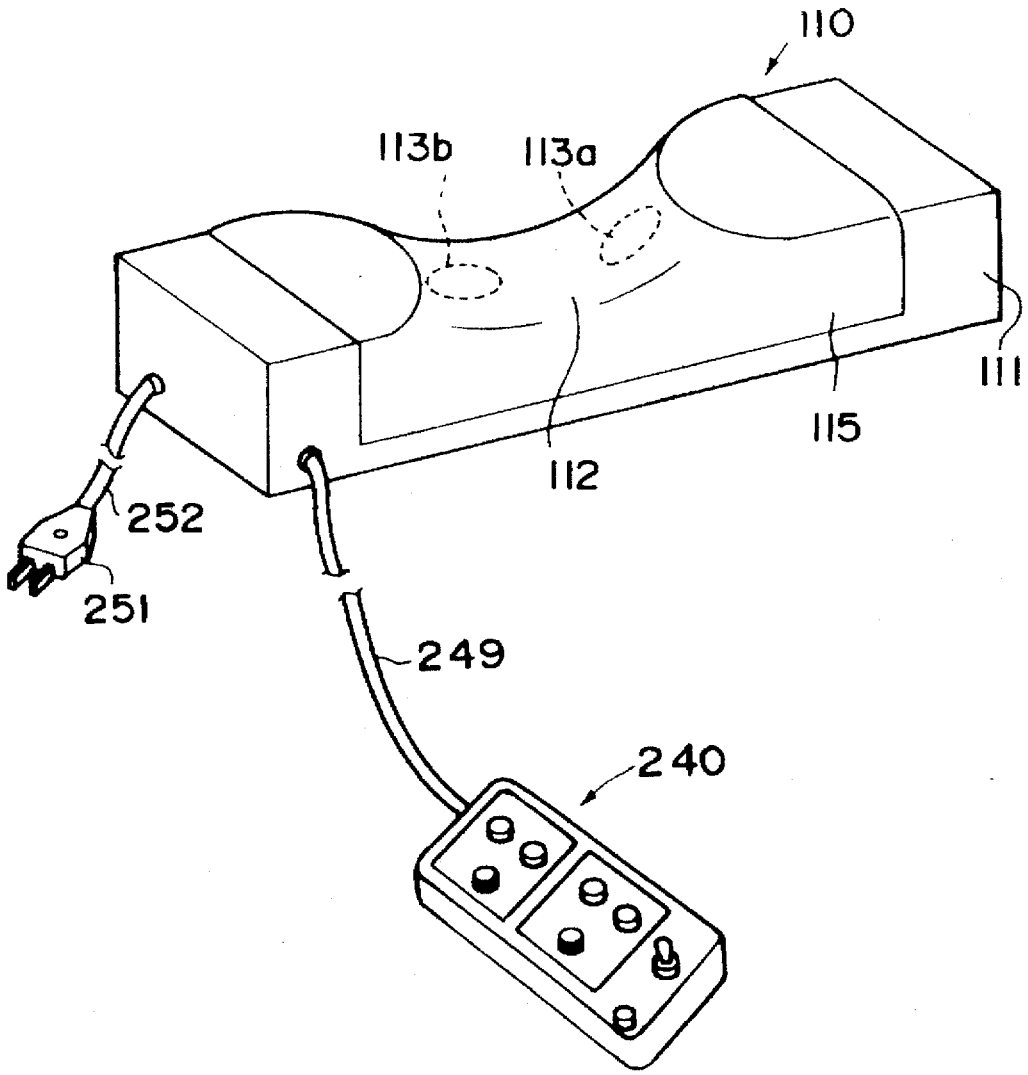
FIG. 17 is a perspective view of the massaging apparatus according to the third embodiment.

A massaging apparatus according to a third embodiment of the present invention is shown in FIG. 17. The massaging apparatus 110 comprises a rectangular box type support body 111 with a curved recess 112 on which the neck portion N will be placed. The top surface of the support body 111 including the curved recess 112 is covered by a cloth cover 115.

Figure 18:
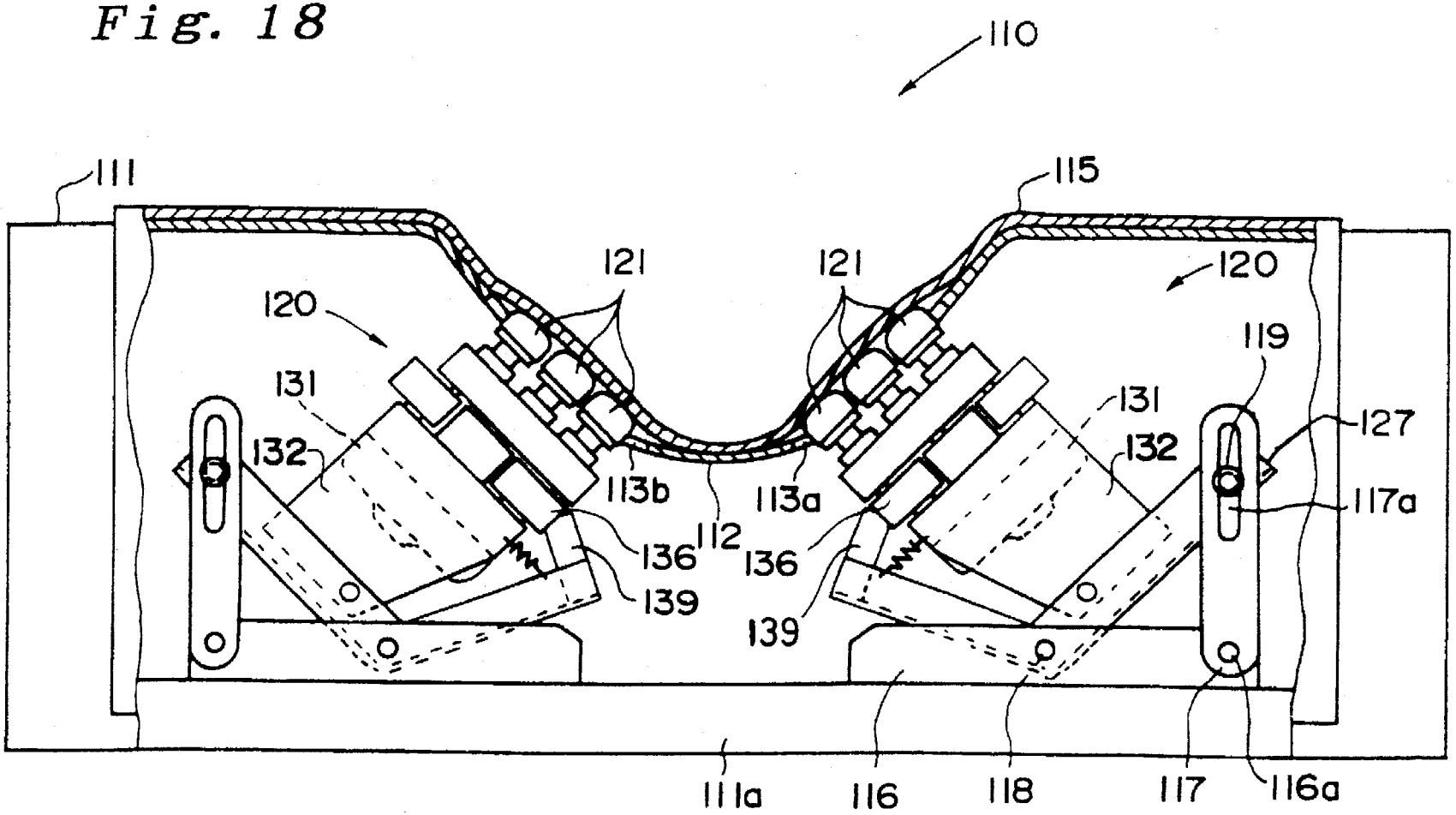
FIG. 18 is a front view, partially in cross-section, of the massaging apparatus shown in FIG. 17.

As also shown in FIG. 18, a right and a left massaging openings 113*a*,113*b* are formed on the curved recess 112. A pair of massaging mechanisms 120 are symmetrically placed in the support body 111. A plurality of pressing members 121 are included in the massaging mechanism 120 and are placed on the upper portion of the mechanism 120. They partially project outward through the massaging opening 113*a*, 113*b*.

Figure 19:
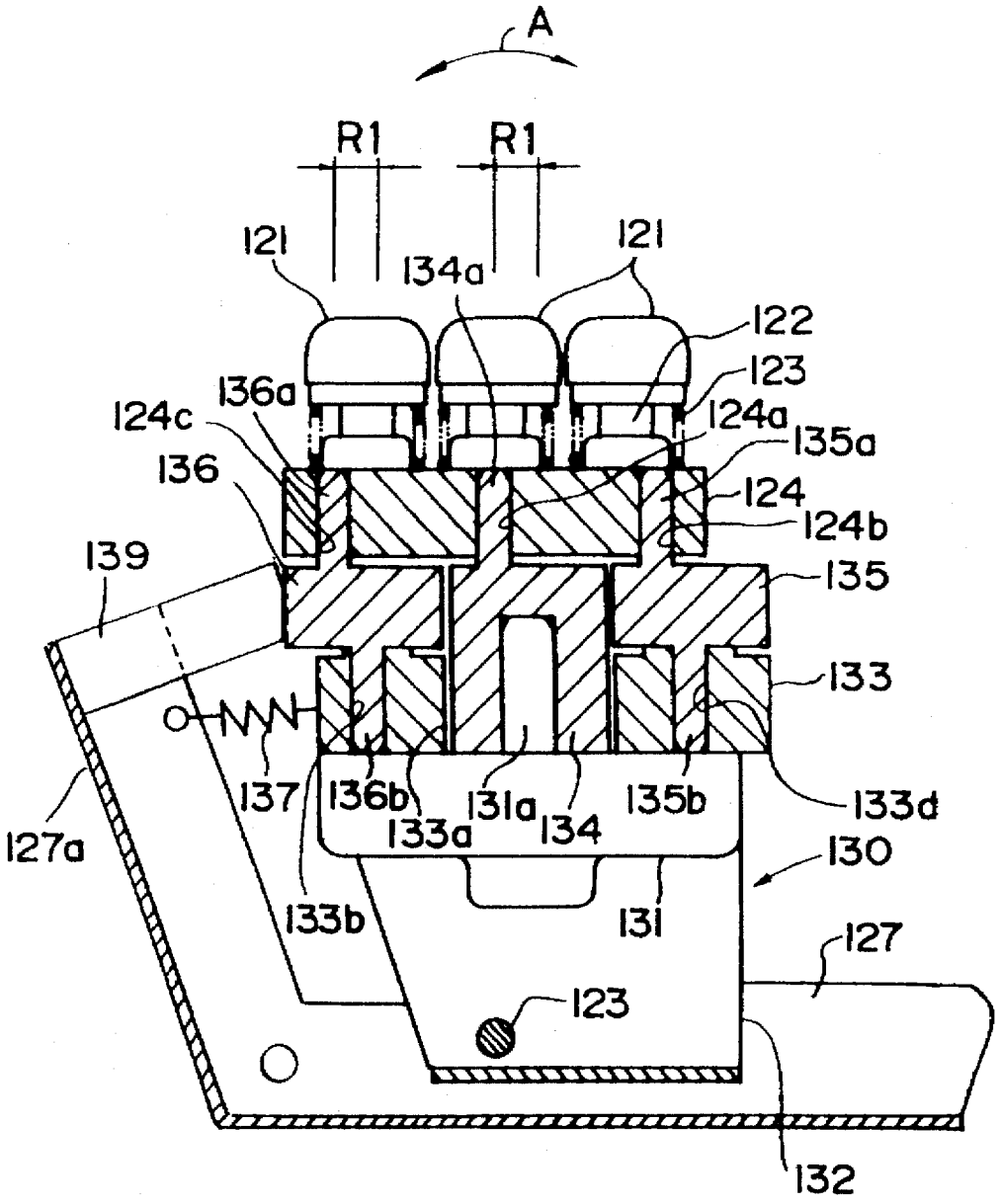
FIG. 19 is a cross-sectional view along the line XIX—XIX shown in FIG. 20.
Figure 20:
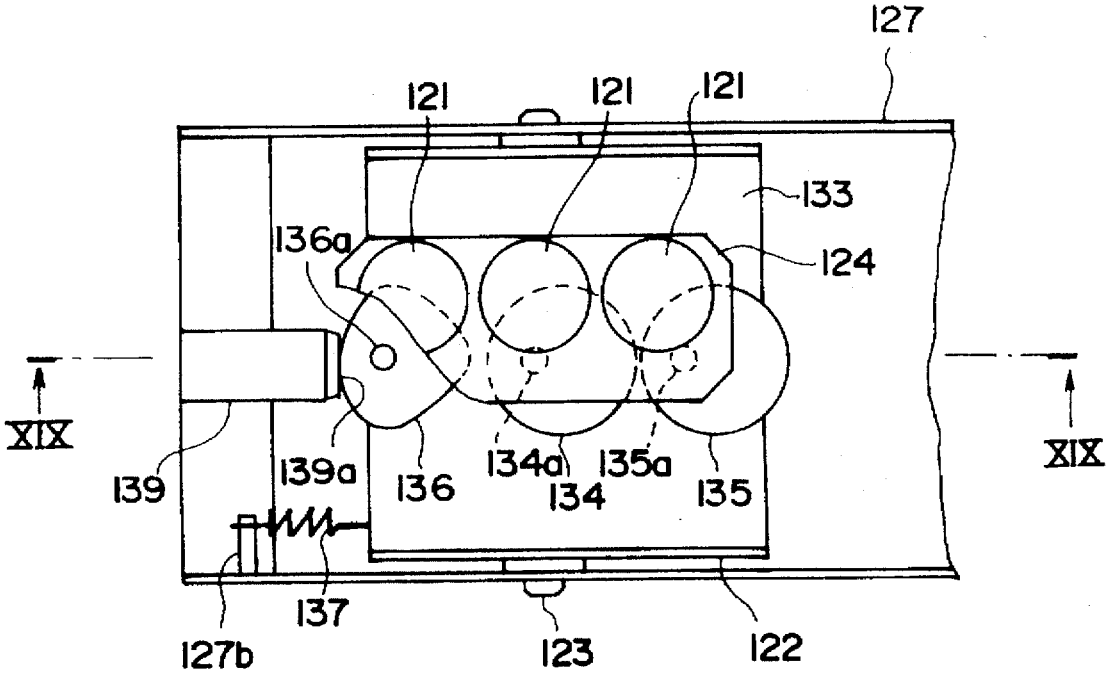
FIG. 20 is a top plan view of the massaging mechanism.
Figure 21:
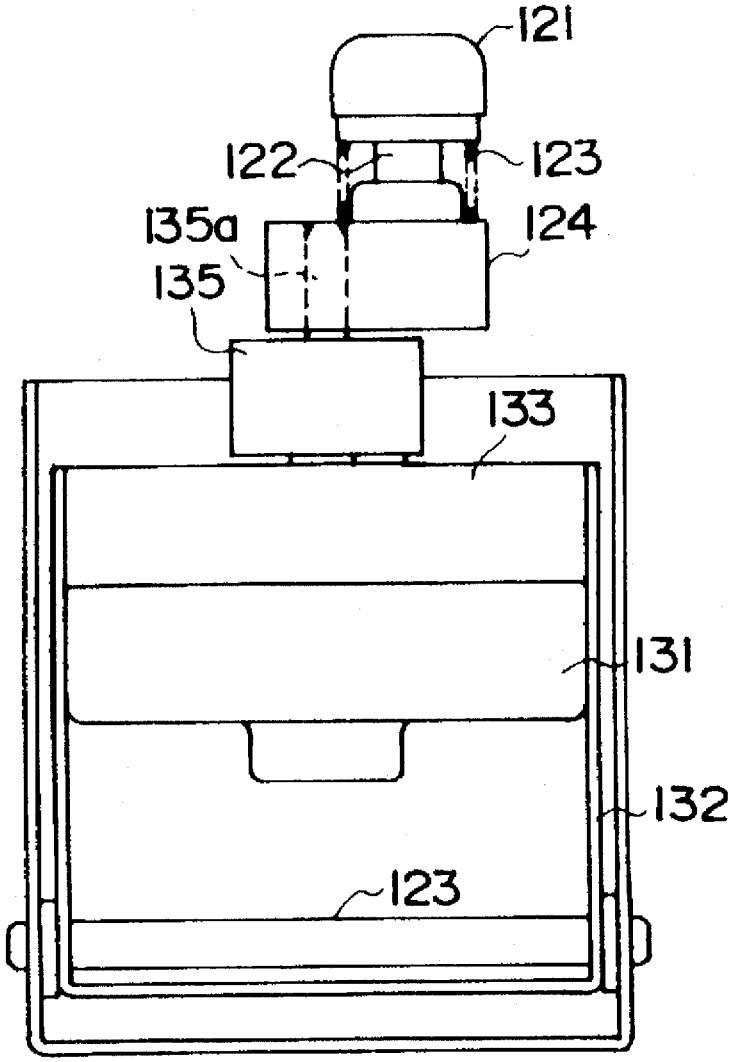
FIG. 21 is a side view of the massaging mechanism.

Next, further referring to FIGS. 19–21, the construction of the massaging mechanism 120 will be described. The massaging mechanism 120 includes a base 127 and a rotational driving device 130 which is swingably mounted on the base 129. The base integrally includes a cam follower support 127*a* which obliquely extends upward. A cam follower 139 is fixed to the cam follower support 127*a* with which a cam 136 will come in contact.

The rotational driving device 130 comprises an electric motor 131, a support frame 132, a motor support 133, a boss 134, a crank member 135 and the cam 138.

The support frame 132 has a U-shaped construction in which the motor support 133 is fixedly mounted. A swing axle 123 is placed penetrating the base 127 and the support frame 132, thereby the support frame 132 being swingably supported by the base 127.

The electric motor 131 is mounted on the motor support 133. A rotational axle 131*a* of the motor 131 extends upward. The boss 134 is fixedly attached to the rotational axle 131*a* and is extended upward through a hole 133*a* formed in the motor support 133. A support axle 134*a* is formed on the upper surface of the boss 134. The center axis of the support axle 134*a* is eccentric from the center axis of the rotational axle 131*a* by a distance "R1".

The support axle 134*a* is loosely fitted into a support hole 124*a* of a pressing member support 124. Another two support holes 124*b*,124*c* are also formed in the pressing member support 124. An upper support axle 135*a* formed on the upper surface of the crank member 135 is loosely fitted into the support hole 124*b*, and an upper support axle 136*a* formed on the upper surface of the cam 136 is also loosely fitted into the support hole 124*c*.

A lower support axle 135*b* is formed at the center of the bottom surface of the crank member 135. The lower support axle 135*b* is loosely fitted into a support hole 133*d* formed in the motor support 133. The center axis of the upper support axle 135*a* is eccentric from the center axis of the lower support axle 135*b* by a distance "RI".

Figure 23A:
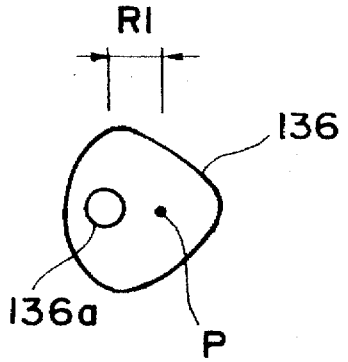
FIGS. 23A–23B are plan views of two different cam members.

The cam 136 has an egg-shape configuration to compose a plate cam as shown in FIG. 23A. A lower support axle 136*b* is formed at the center of the bottom surface of the cam 136. The lower support axle 136*b* is loosely fitted into a support hole 133*b* formed in the motor support 133. The center axis of the upper support axle 136*a* is also eccentric from the center axis of the lower support axle 136*b* by a distance "R1".

A tension spring 137 is placed between the cam follower support 127*a* and the motor support 133 so as to pull the massaging mechanism 120 toward the cam follower support 127*a*. Accordingly, the outer peripheral surface of the cam 136 is kept in contact with a contact surface 139*a* of the cam follower 139.

In the rotational driving device 130 as constructed above, when the electric motor 131 is driven, the pressing member support 124 executes a circular motion with a radius "R1" and the pressing members 121 also execute a circular motion respectively.

Figure 22:
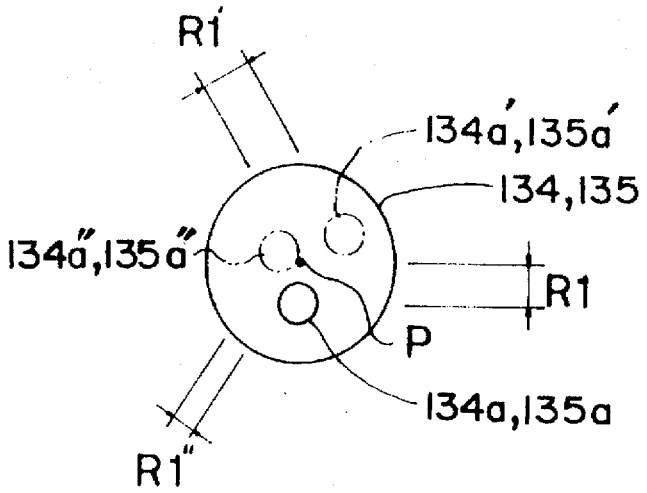
FIG. 22 is a plan view of the crank member of the massaging mechanism.

The radius "R1" of the circular motion depends on the location of the upper support axles 134*a*,135*a*,136*a*. As shown in FIG. 22, for example three holes 134*a*, 134*a*', 134*a*" and 135*a*,135*a*',135*a*" can be formed on the upper surface of the boss 134 and the crank member 135. Similar three holes 136*a*,136*'a*,136*a*" can also be formed on the upper surface thereof. If the upper support axle 134*a*,135*a*, 136*a* are detachable, they can be selectively inserted in either of the holes to adjust the radius "RI".

When the electric motor 131 is driven, the cam 136 is rotated while being kept in contact with the cam follower 139. As a result, the rotational driving device 130 is moved reciprocatingly as shown by an arrow "A" in FIG. 19.

Since the circular motion and the reciprocating motion of the pressing member 121 is simultaneously executed by the rotational driving device 130, the pressing member 121 is moved so as to describe an ellipse locus.

The motion along an ellipse locus will be described in detail referring FIG. 24.

Figure 24A:
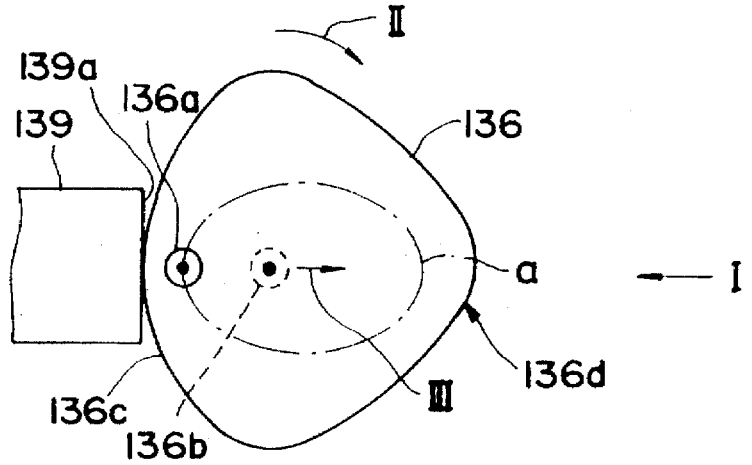
FIGS. 24A–24D are top plan views of the cam member and the cam follower to illustrate the locus of the support axle.
Figure 24B:
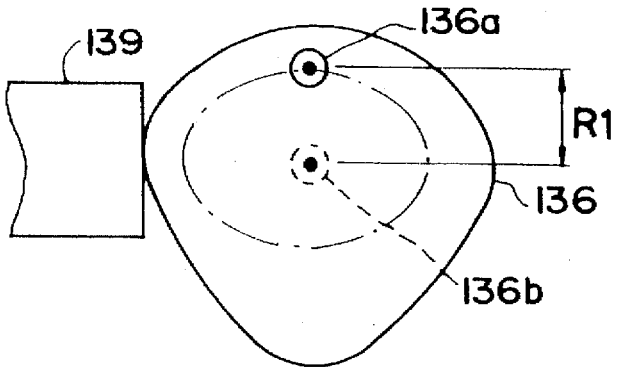
Figure 24C:
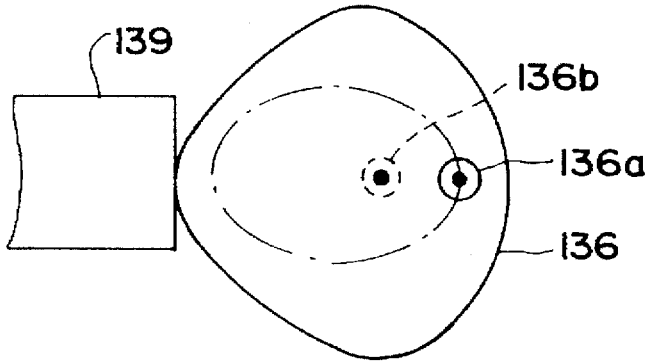
Figure 24D:
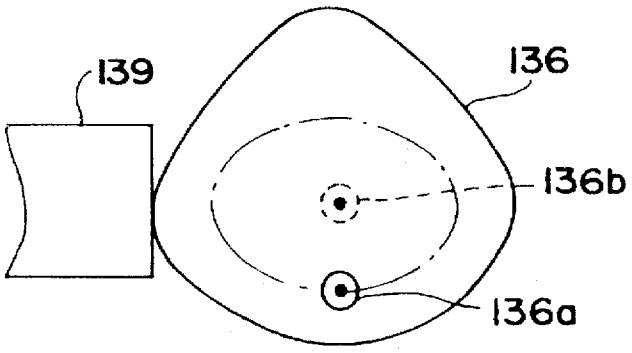

The cam 136 is kept in contact with the contact surface 139*a* of the cam follower 139 as shown in FIG. 24A because of the tensile rotated "I" by the spring 137. When the cam 136 is rotated around the lower support axle 136*b* clockwise as shown by an arrow "II", the cam 136 is clockwisely rotated while being kept in contact with the cam follower 139 to move the lower support axle right with respect to the cam follower 139 as shown by an arrow "III".

Namely, the upper support axle 136*a* is rotated along a circle with a radius "R1" moving right. Consequently, the upper support axle 136*a* is moved so as to describe an ellipse locus as shown in FIGS. 24A–24D.

Figure 23B:
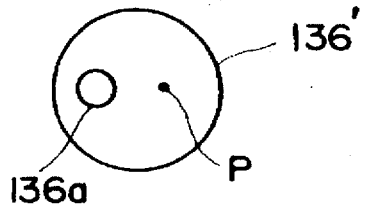

The pressing member support 124 and the pressing members 121 is also moved along the same size ellipse locus. The shape of the ellipse can be varied by changing the outer peripheral configuration of the cam 136. For example, an ellipse configuration cam or a circular configuration cam 136' with an eccentric axis as shown in FIG. 23B can be used instead of the cam 136 as shown in FIG. 23A.

The pressing member 121 is made of elastic material (such as rubber) or plastic. The pressing member 121 is mounted on a movable axle 122 which is vertically movable against the pressing member support 124. The pressing member 121 and the movable axle 122 is pushed upward by a spring 123. A vertical position adjusting mechanism to adjust the vertical position of the pressing member 121 (and the movable axle 122) can be included in the pressing member support 124. Vertical position adjusting button 343*a*, 343*b* to control the operation of the vertical position adjusting mechanism are included in a controller 240 which will be described later.

The upper portion of the pressing members 121 are projecting upward through the massaging opening 113. When the pressing members 121 are moved so as to describe the ellipse locus, the neck portion N of the patient M placed on the curved recess 112 is massaged by the pressing members 121. In order to effectively massage the neck portion N, the massaging opening 113 is formed at a place where a specific location for effectively relieving stiffness faces.

The electric motor 131 is driven by an electric power supplied through an electric wire 252 and a plug 251 plugged into an outlet. The operation of the electric motor 131 is controlled by the controller 240.

Figure 25:
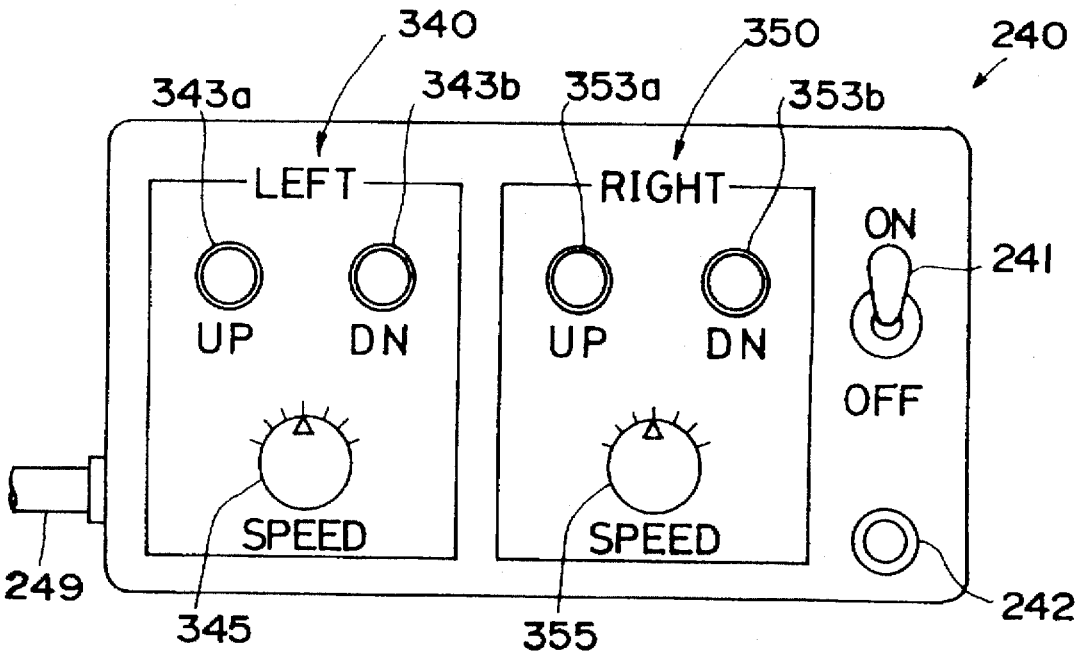
FIG. 25 is a plan view of the controller.

The controller 240 comprises a remote control unit separately located from the support body 111 as shown in FIG. 17. The controller 240 is connected by a control wire 249 with the electric motor 131. As shown in FIG. 25, the controller 240 comprises a main switch 241, an operational indicating lamp 242,a left controlling unit 240 and a right controlling unit 250.

The main switch 241 controls the electric power supply. When it is turned on, the electric power is supplied to the motor 131 through the electric wire 252 to drive the motor 131. When it is turned on, the operation indicating lamp 242 is simultaneously turned on. The left and right controlling units 340,350 are respectively used to operationally control the left and right massaging mechanisms 120. Since the left and the right controlling units 340,350 have the same construction with each other, only the left unit 340 is described here.

The left controlling unit 340 comprises the vertical position adjusting buttons 343*a*,343*b* and a motor control knob 345.

The vertical position adjusting buttons 343*a*,343*b* are used to adjust the vertical position (the amount of the vertical projection) of the pressing member 121 and the movable axle 122. When the up-button 343*a* is pushed down, the pressing member 121 is moved upward. When the down-button 343*b* is pushed down, the pressing member 121 is moved downward.

The motor control knob 345 is used to control the rotational speed and direction of the electric motor 131. When it is turned right from a neutral position (the position shown in FIG. 25), the motor 131 is rotated clockwise. When turned left, the motor 131 is rotated counter-clockwise. The further it is turned right or left, the faster the motor 131 rotates.

The massaging mechanism 120 is pivotally mounted to the base plate 116 by a pin 118. The mounting angle of the massaging mechanism 120 can be adjusted by a support pole 117.

The massaging mechanism 120 is mounted on the bottom plate 111*a* through the base plate 116 so as to allow a horizontal adjustment of location. The horizontal location can be adjusted by the same manner as shown in FIG. 15.

In the above embodiments, the pressing member is moved along an ellipse locus by combining a circular motion and a reciprocating motion. The present invention is not limited to such a mechanism. Any different mechanism to move the pressing member so as to describe an ellipse locus can be used in the present invention.

Figure 26A:
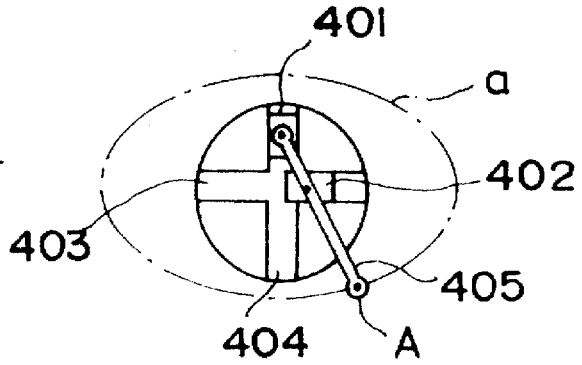
FIGS. 26A–26I are front views of various elliptical mechanisms.

For example, as shown in FIG. 26A, an elliptic trammel mechanism comprising two perpendicular grooves 403,404, two sliders 401,402 slidably placed in the grooves 403,403 and an arm 405 pivotally connected to the sliders 401,40Z can be used. The tip end "A" of the arm 405 can describe an ellipse locus "a". To apply the mechanism in the massaging apparatus, the pressing member will be mounted on the tip end A of the arm 405.

Figure 26B:
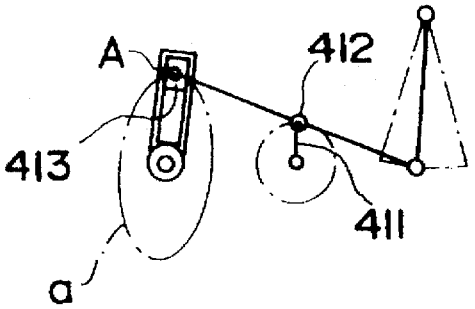
Figure 26C:
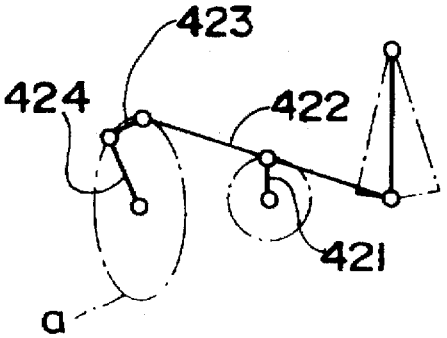

An ellipse-crank mechanism as shown in FIG. 26B can be used. It comprises crank members 411,412 and slider 413. When the crank member 411 is rotated around one end thereof, the slider connecting point A will describe an ellipse locus "a". A similar ellipse-crank mechanism comprising link members 421–424 as shown in FIG. 26C can also be used.

Figure 26D:
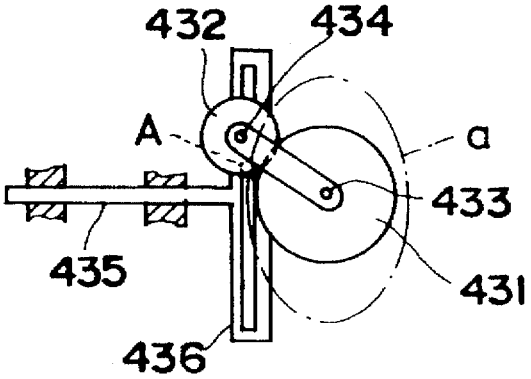

A scotch-yoke mechanism shown in FIG. 26D can be used. It comprises a stationary gear 431, a planetary gear 432 and a yoke 436 with a slide axle 435. The planetary gear 432 has a slide pin A eccentrically located form its axis. When the planetary gear 432 is rotated around the stationary gear 431, the slide pin A describe an ellipse locus "a".

Figure 26E:
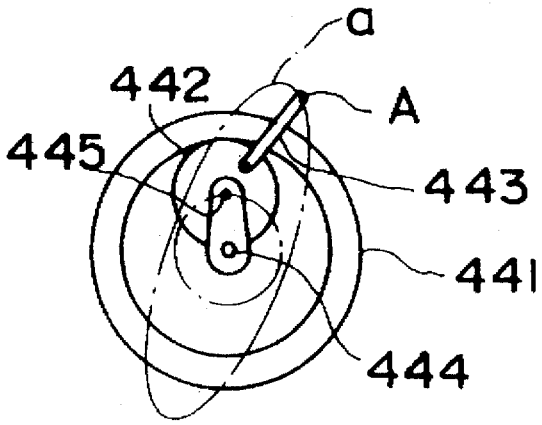

An elliptic mechanism having a stationary internal gear 441 and a planetary external gear 442 as shown in FIG. 26E can also be used. When the planetary gear 442 is rotated around an axis 444, a tip end A of arm 443 describe an ellipse locus "a".

Figure 26F:
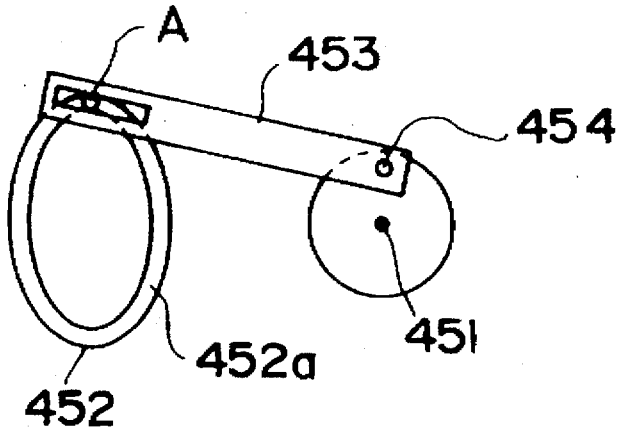

Another elliptic mechanism having an ellipse cam 452 with an ellipse groove 452*a*, and crank members 451,453 as shown in FIG. 26F can be used.

Figure 26G:
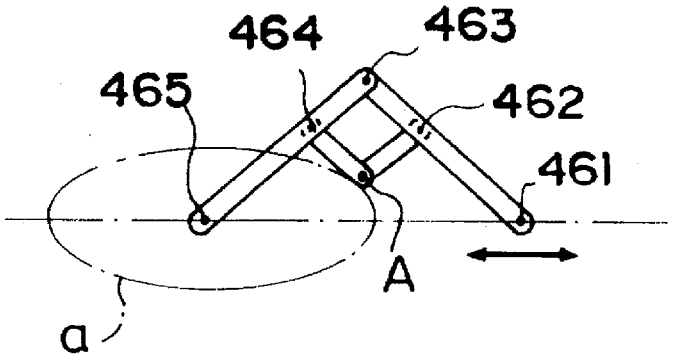

An ellipsograph mechanism having four link members pivotally connected at the points 481–485 as shown in FIG. 26G can be used. When the end point 481 is slidably moved along a straight line with respect to the fixed point 465, the point "A" describe an ellipse locus "a".

Figure 26H:
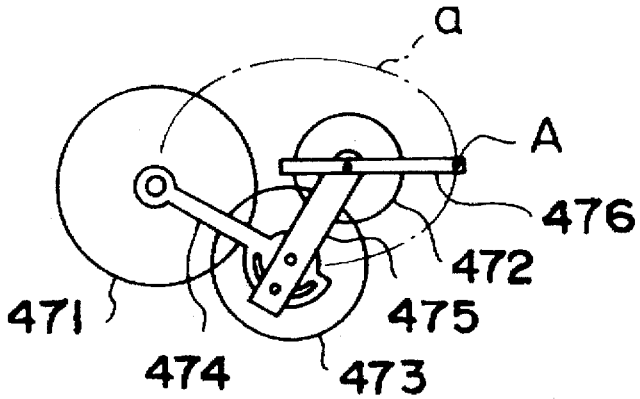

Further a mechanism as shown in FIG. 26H can be used. The mechanism comprises three gears 471,472,473, two link members 474,475 and an arm member 476. The center gear 472 meshes the other gears 471 and 473, and the gear 471 is stationary held against rotation. The arm member 476 rotates with the gear 473.

Figure 26I:
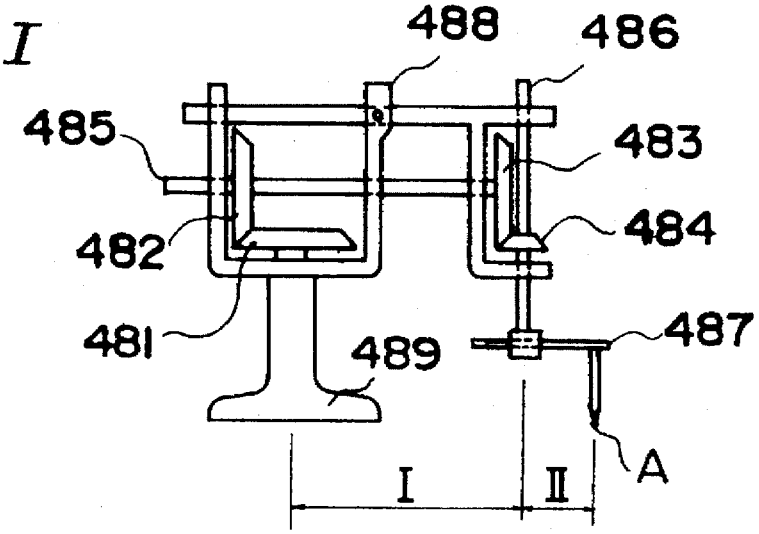

A mechanism as shown in FIG. 26I can also be used. It includes two pairs of bevel gears 481,482 and 483,484, and two axles 485,486. The bevel gear 481 is stationary held against rotation. At the end of the axle 486, an arm member 487 is attached. When the frame 488 is rotated, the point A at the tip end of the arm member 487 describe an ellipse locus.

Figure 27:
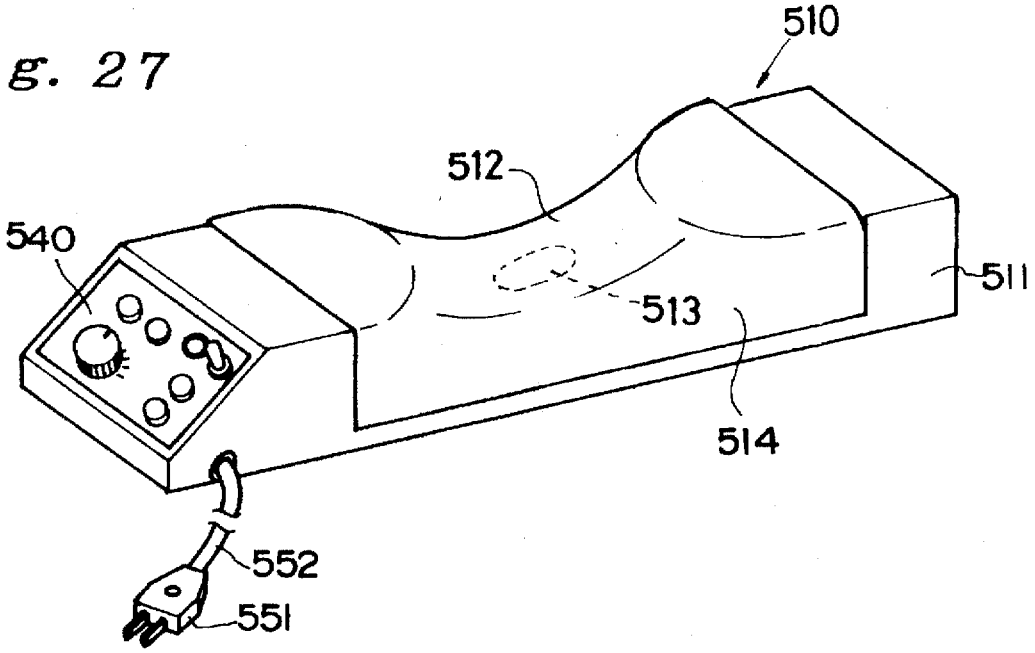
FIG. 27 is a perspective view of the massaging apparatus according to an another embodiment.

A massaging apparatus according to a fourth embodiment of the present invention is shown in FIG. 27. The massaging apparatus 510 comprises rectangular box type support body 511 with a curved recess 512 on which a specific portion (such as a neck portion) of a patient will be placed. The top surface of the support body including the curved recess 512 is covered by a cloth cover 514.

Figure 28:
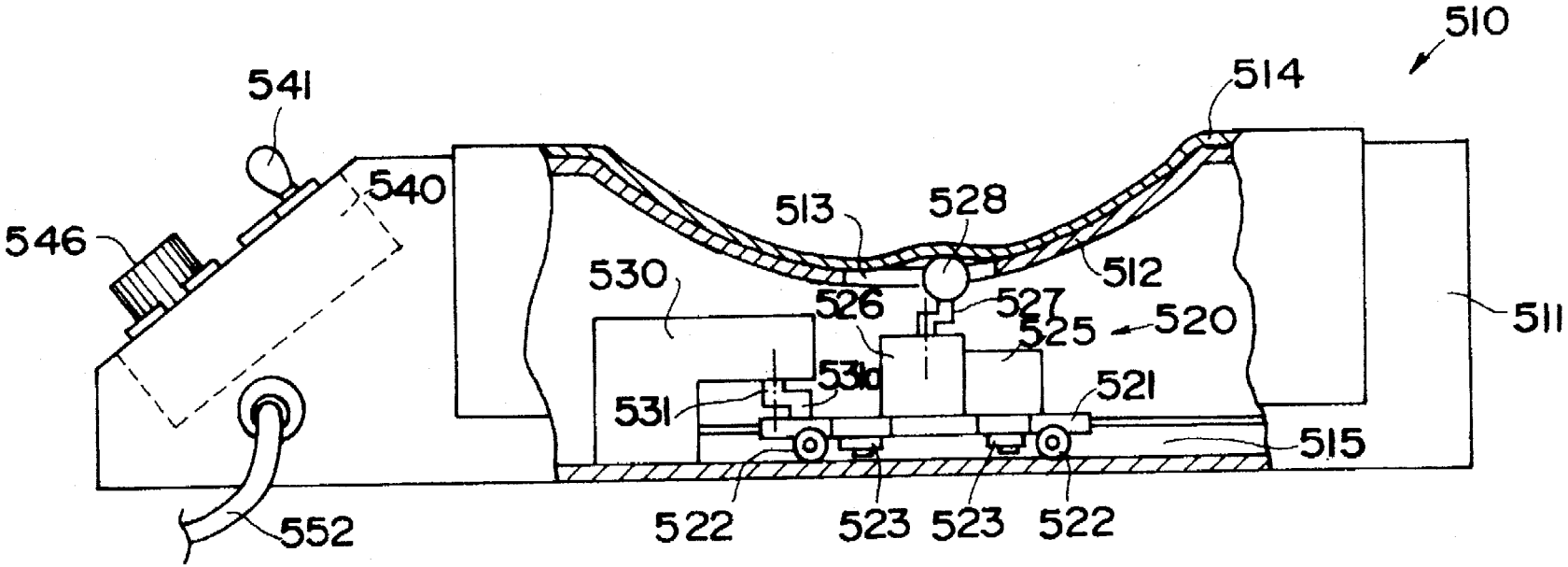
FIG. 28 is a front view, partially in cross-section, of the massaging apparatus.

As shown in FIG. 28 also, a massaging opening 513 is formed on the curved recess 512. A massaging mechanism 520 is placed inside the support body 511. A pressing member 528 placed on the upper portion of the mechanism 520 is partially projecting outward through the massaging opening 513.

The massaging mechanism 520 includes a reciprocating member 521 which is provided in the support body 511 so as to move back and forth along a pair of guide rails 515. As shown in detail in FIGS. 29 and 30, the reciprocating member 521 comprises four vertical guide rollers 522 and four horizontal guide rollers 523 to allow a smooth reciprocating motion of the reciprocating member 521.

An electric motor 525 and a speed reduction device 526 are mounted on the reciprocating member 521. A crank-shaped first rotational axle 527 is extended upward from the speed reduction device 528. A spherical pressing member 528 is rotatively mounted on the top end of the first rotational axle 527.

Figure 31:
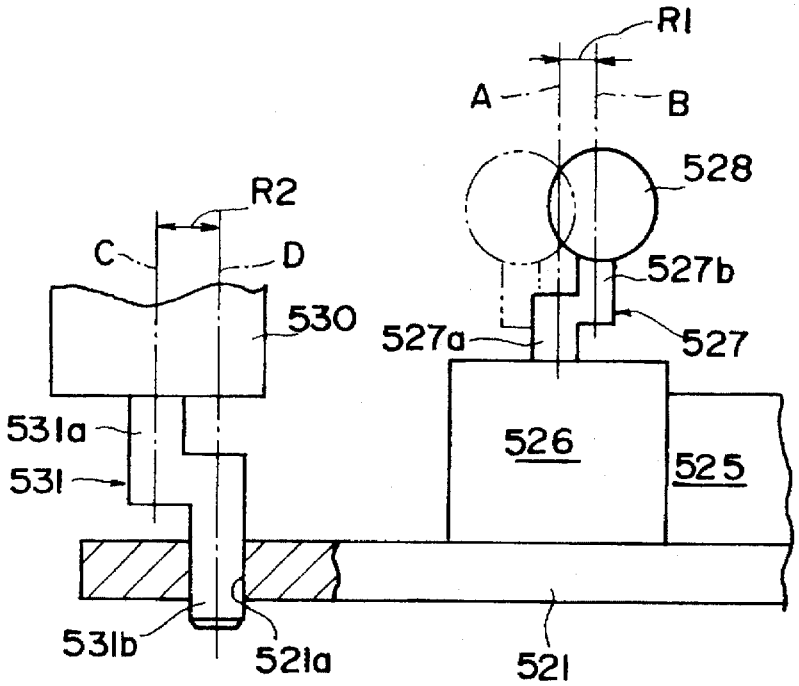
FIG. 31 is a partial front view of the massaging mechanism.

As shown in FIG. 31, the first rotational axle 527 includes a base portion 527*a* which is rotative around an axis "A" and a tip portion 527*b* having a vertical axis "B". The axis "B" is eccentric from the axis "A" by a distance "R1".

When the first rotational axle 527 is rotated around the axis "A" of the base portion 527*a* by the electric motor 525. The pressing member is rotated along a circle around the axis "B" with a radius "R1" in a plane perpendicular to the axis "A".

Figure 29:
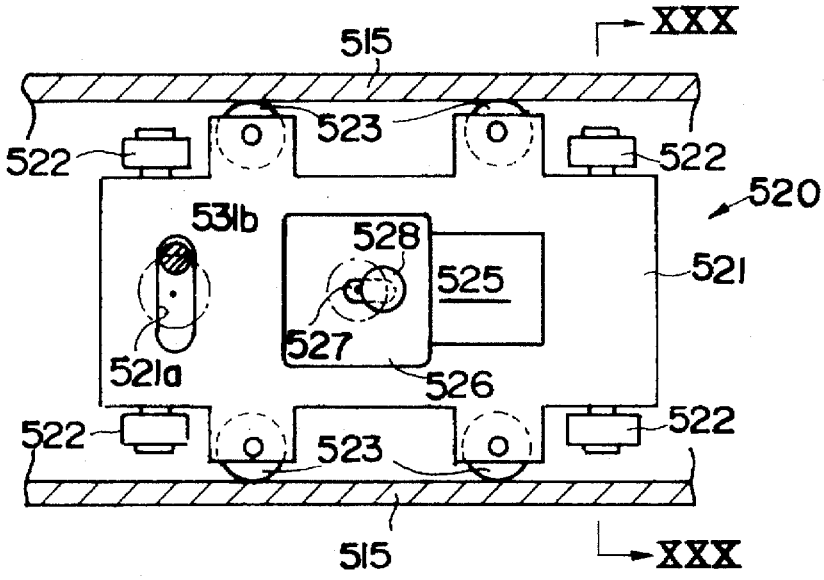
FIG. 29 is a plan cross-sectional view of the reciprocating members.
Figure 30:
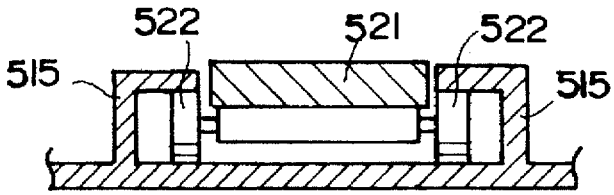
FIG. 30 is a side cross-sectional view along the line XXX—XXX shown in FIG. 29.

A reciprocating drive mechanism 530 having a crank-shaped second rotational axle 531 is provided on the front side of the reciprocating member 521. The drive mechanism 530 comprises an electric motor and a speed reduction device to rotate the second axle 531 around a base portion 531*a* of the axle 531. As shown in FIG. 29, a slot 521*b* is formed in the reciprocating member 521. A tip portion 531*b* of the second rotational axle 531 is loosely inserted into the slot 521*b*. An axis "C" of the base portion 531*a* is eccentric from an axis "D" of the tip portion 531*b* by a distance "R2". When the second rotational axle 531 is rotated around the axis "C" of the base portion 531*a* by the reciprocating drive device 530, the tip portion 531*b* is rotated along a circle around the axis "C" with a radius of "RE".

Since the tip portion 531b is inserted into the slot 521a, as the tip portion 531b is rotated, the reciprocating member 521 is moved back and forth by a distance "2*,R2".

Figure 32A:
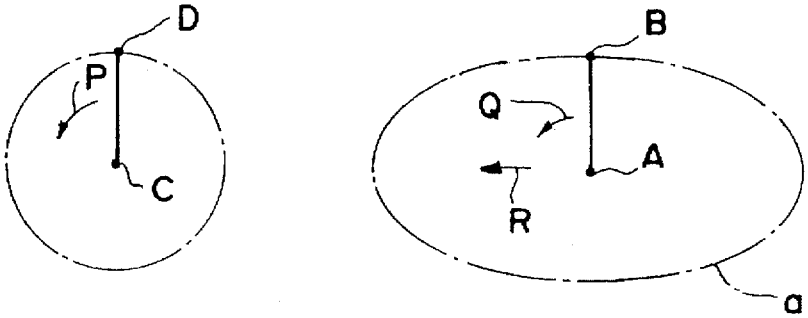
FIGS. 32A–32B are diagrams to illustrate the loci of the pressing member.

If the first rotational axle 527 is rotated in synchronism with the second rotational axle 531, the axis "D" of the second rotational axle 531 is rotated around the axis "C" as shown by an arrow "P" in FIG. 32A. Also, the axis "B" of the first rotation axle 527 is rotated around the axis "A" as shown by an arrow "Q". Consequently, the axis "A" is moved right as shown by an arrow "R" and rotated as shown by the arrow Q. The resultant moving locus of the axis "B" is an ellipse as shown by a chain line "a".

Figure 32B:
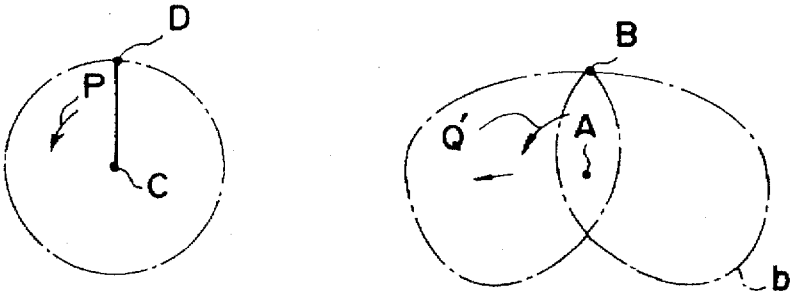

If the first rotational axle 527 is rotated twice as fast as the second rotational axle 531, the resultant moving locus of the axis "B" becomes substantially a figure "8" as shown in FIG. 32B.

As described above, the upper portion of the pressing member 528 is projecting outward through the massaging opening 513. When the pressing member 528 is moved transversely so as to describe the locus of ellipse or figure "8", the neck portion of the patient placed on the support body 511 is massaged by the pressing member 828. Since the massaging opening 528 is formed at a place where a specific location of the body for effectively relieving stiffness faces, the specific location is massaged by the pressing member 528 which is moved along the locus of either an ellipse or a figure "8".

The speed reduction device 528 has an additional mechanism to move the first rotational axle 527 up and down, whereby the amount of outward projection of the pressing member 528 through the massaging opening 513 being adjusted.

The electric motor 525 is driven by an electric power supplied through an electric wire 552 and a plug 551 plugged into an outlet. The operation of the electric motor 525 is controlled by a controller 540.

Figure 33:
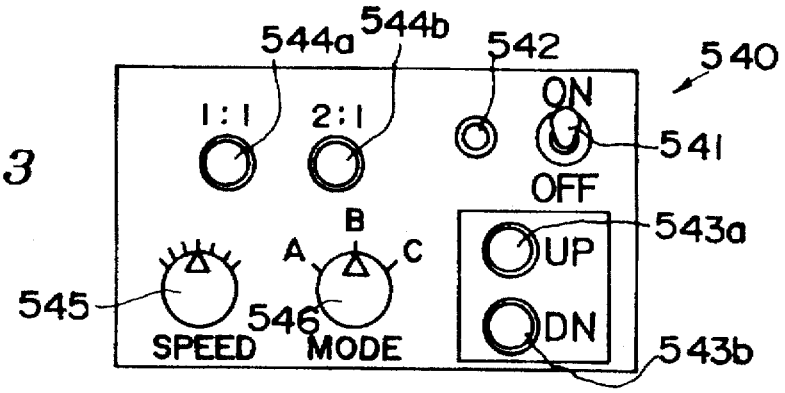
FIG. 33 is a front view of the controller.

The controller 540 comprises a main switch 541, an operation indicating lamp 542, projection adjusting buttons 543a,543b, speed ratio selection buttons 544a,544b, a speed control knob 545 and a mode selection knob 546 as shown in FIG. 33. The main switch 541 controls the electric power supply. When it is turned on, the operation indication lamp 542 is simultaneously turned on.

The speed ratio selection buttons 544a,544b are used to determine the speed ratio of the first and the second rotational axles 527,531. When the first selection button 544a is pushed, both the first and second rotational axle 527,531 rotate at the same speed to move the pressing member 528 along the ellipse locus. When the second selection button 544b is pushed, the first rotational axle 527 is rotated twice as fast as the second rotational axle 531 to move the pressing member 528 along the locus of figure "8".

The rotational speed of the first and second rotational axles 527,531 can be adjusted by the speed control knob 545.

Either A-mode, B-mode or C-mode can be selected by the mode selection knob 548. When the A-mode is selected, only the first rotational axle 527 is rotated to move the pressing member 528 along a circular locus. When the B-mode is selected, both the first and the second rotational axles 527,531 are rotated to move the pressing member along the locus of the ellipse or the figure 37 8". When the C-mode is selected, only the second rotational axle 531 is rotated to move the pressing member 528 back and forth reciprocatingly.

Figure 34A:
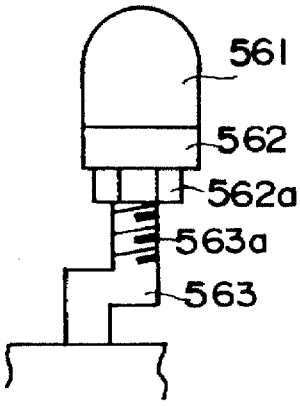
FIGS. 34A–34B are front views of two different pressing members.

In the above embodiment, the pressing member 528 has a ball-like configuration. A pressing member 581 having a cylindrical configuration with a spherical top as shown in FIG. 34A can be used. The pressing member 561 is rotatively mounted on a support 562 which is threaded onto a thread portion 563a of a rotational axle 563. Accordingly, the vertical position of the support 562 can be adjusted by the threading adjustment to adjust the amount of the projection of the pressing member 561 through the massaging opening 513. The support 562 can be fixed by a fixing nut 562a.

Figure 34B:
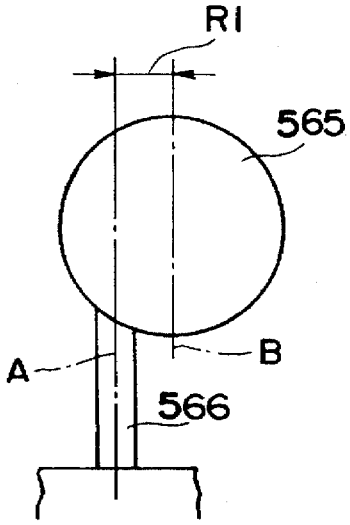

A spherical pressing member 565 eccentrically mounted on the straight rotational axle 566 as shown in FIG. 34B can also used. The spherical center line B is eccentric from the axis A of the axle 566 by a distance "R1".

Figure 35:
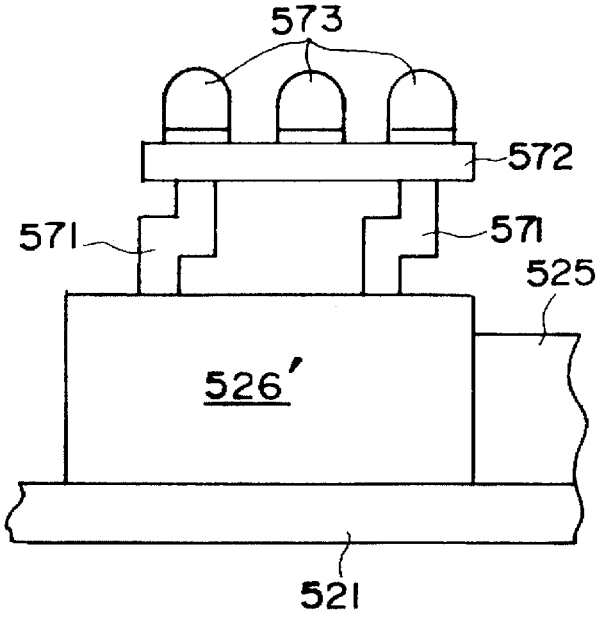
FIG. 35 is a front view of an another massaging mechanism.

A fifth embodiment according to the present invention is shown in FIG. 35. In the embodiment, two first rotational axles 571 is rotatively mounted on a speed reduction device 526'. A support plate 572 having three pressing members 573 is supported by the first rotational axles 571. The pressing members 573 are rotatively mounted on the support plate 572 respectively. When the two first rotational axles 571 are rotated, the support plate 572 is moved along the same circular locus as that of the upper portion of the first rotational axles 571. Consequently, all the pressing members 571 can be moved along the locus of ellipse or figure "8".

Figure 36:
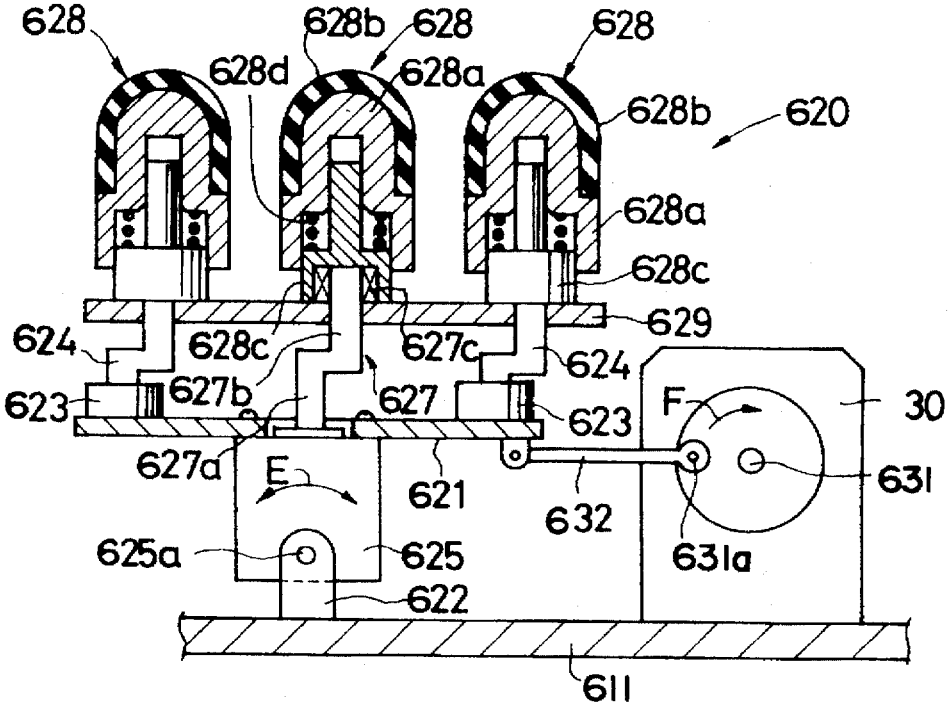
FIG. 36 is a cross-sectional view of a different massaging mechanism.

A massaging mechanism 620 as shown in FIG. 36 can be used. The massaging mechanism 620 comprises a rotational drive motor 625 which is pivotally mounted around a pivot axle 625a on the support body 611 through a support arm 622. It further comprises a reciprocation drive motor 630 fixedly mounted on the support body 611. A swing plate 621 is mounted on the rotational drive motor 625, and two crank-shape sub-rotational axles 624 are rotatively mounted on the swing plate 621 through rotation support members 623. A support plate 629 is supported by the sub-rotational axles 624.

A first rotational axle 627 of the rotational drive motor 625 also has a crank-shape. The upper end of the first rotational axle 627 is rotatively connected to a fixed axle 628c through a bearing 627c. A pressing member 628 is rotatively mounted on the upper end of the fixed axle 628c. The pressing member 628 is pushed upward by a spring 628d. The pressing member 628 includes a metal body 628a and a rubber cover 628b.

Two more fixed axles 628c are respectively mounted on the upper ends of the fixed axles 628c, and two more pressing members 628 are mounted on the upper end of the axles 628c.

One end of a reciprocation arm 632 is connected to the reciprocation drive motor 630 at a point eccentric from a drive axle 631 of the motor 630. The other end of the arm 632 is connected to the swing plate 621.

When the reciprocation drive motor 630 is driven, the swing plate 621 is swung back and forth to move the pressing members 628 back and forth reciprocatingly. If the rotational drive motor 625 is simultaneously driven, the pressing members 628 can be moved so as to describe the locus of an ellipse or a figure "8".

Figure 37:
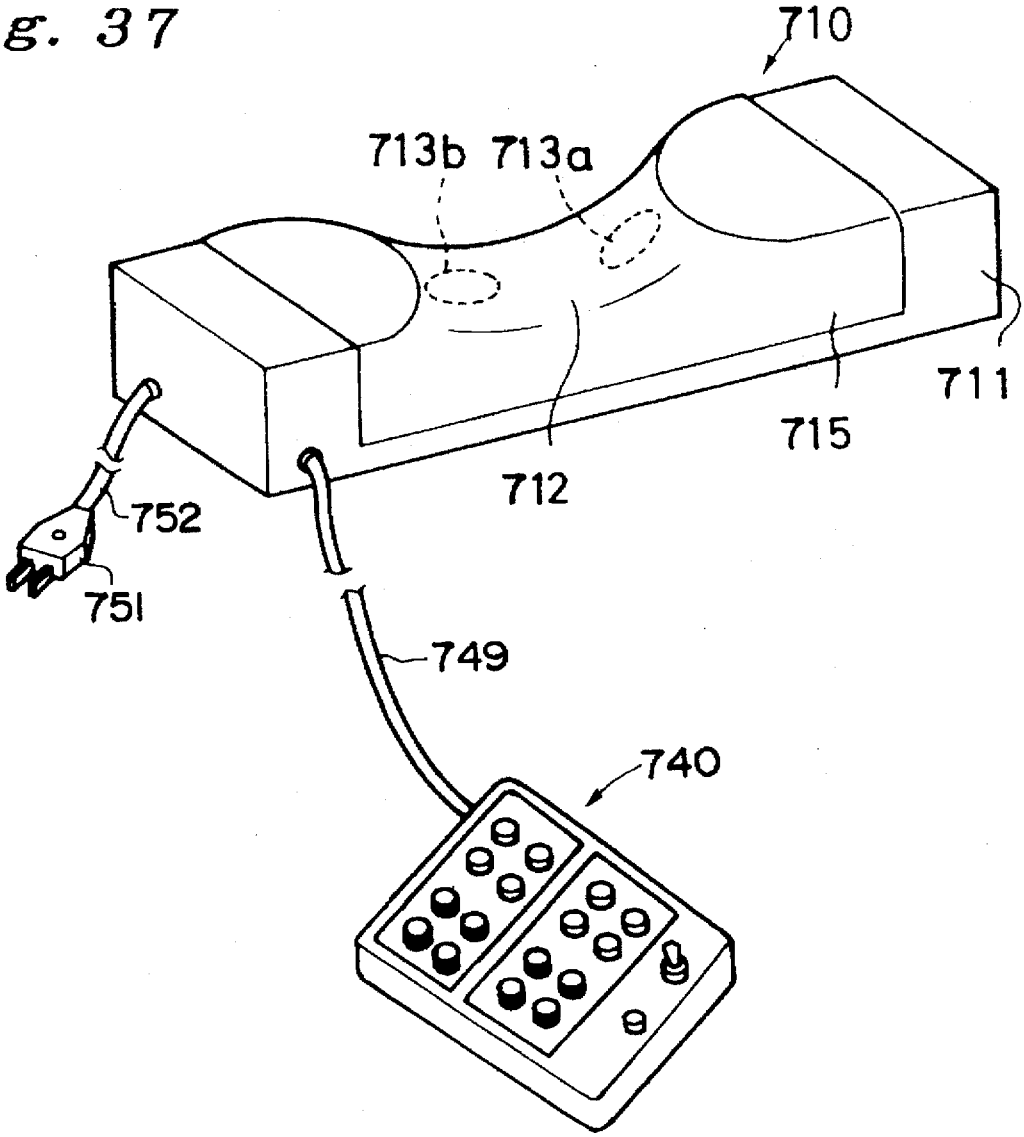
FIG. 37 is a perspective view of a different massaging apparatus.

A massaging apparatus 710 according to a different embodiment of the present invention is shown in FIG. 37. The massaging apparatus 710 comprises a rectangular box type support body 711 with a curved recess 712 on which a neck portion of a patient will be placed. The top surface of the support body 711 is covered by a cloth cover 715.

Figure 38:
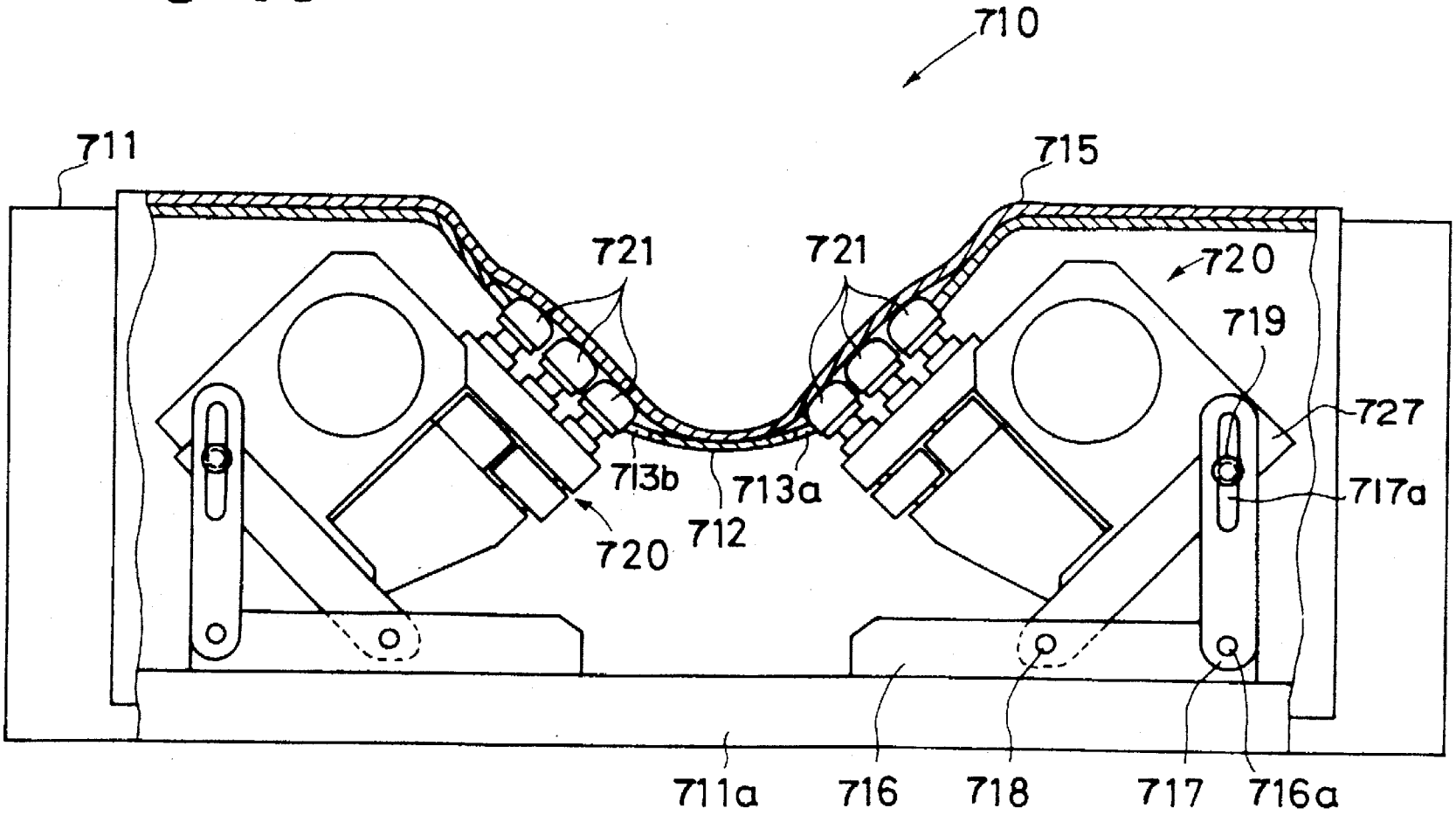
FIG. 38 is a cross-sectional view of the massaging apparatus.

As also shown in FIG. 38, a pair of massaging openings 713a,713b are formed on the curved recess 712. A pair of massaging mechanisms 720 are symmetrically placed in the support body 711. Pressing members 721 provided on the upper portion of the mechanism 720 are partially projecting outward through the massaging openings 713*a*,713*b*.

Figure 39:
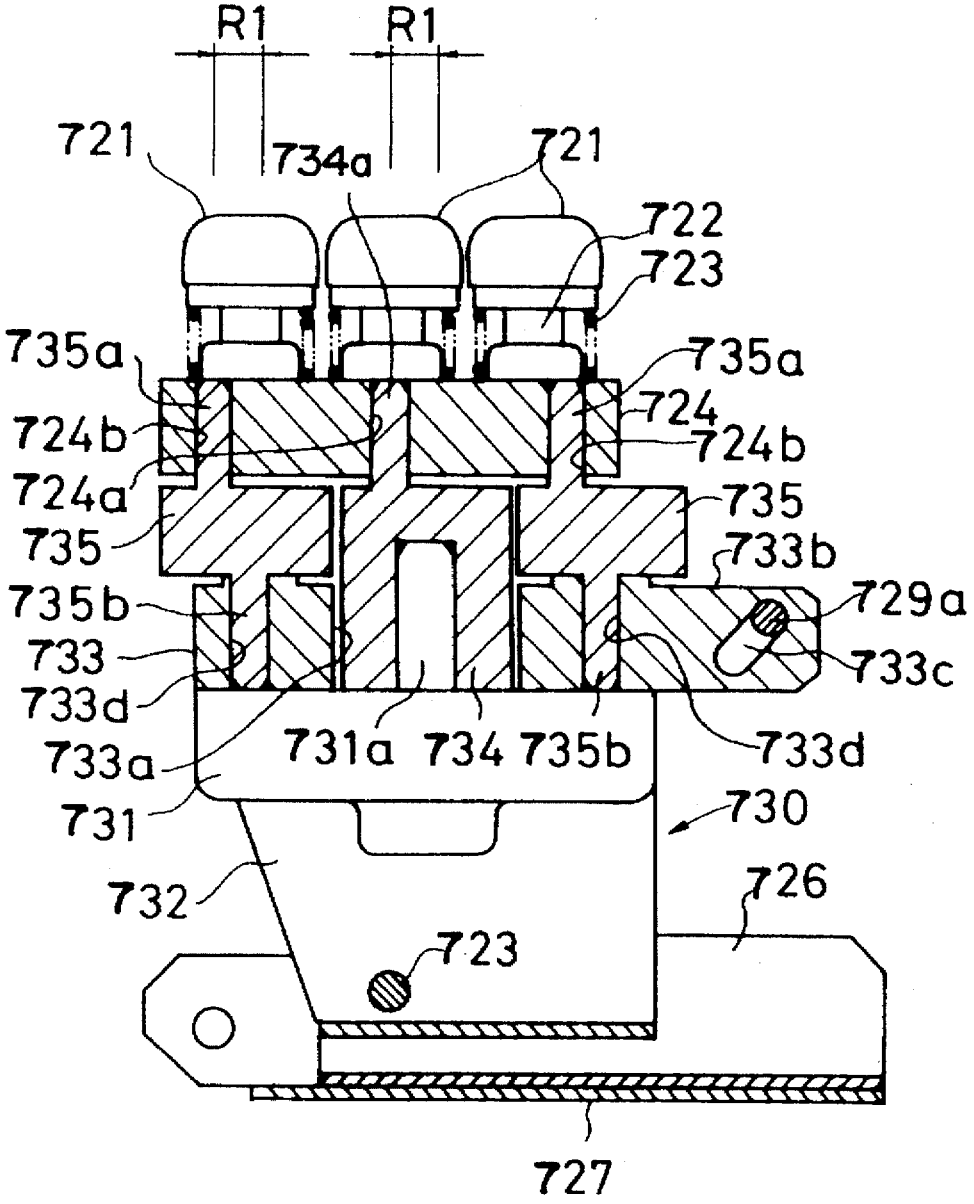
FIG. 39 is a cross-sectional view along the line 39—39 shown in FIG.40.
Figure 40:
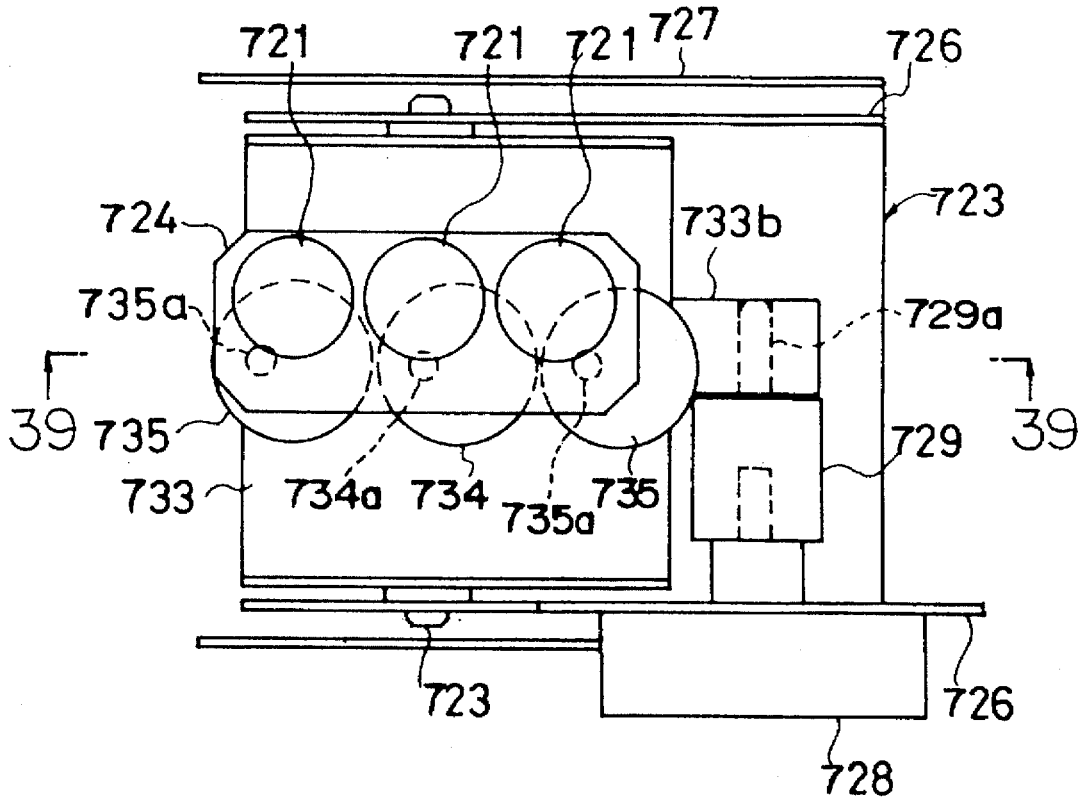
FIG. 40 is a top plan view of the massaging mechanism.
Figure 41:
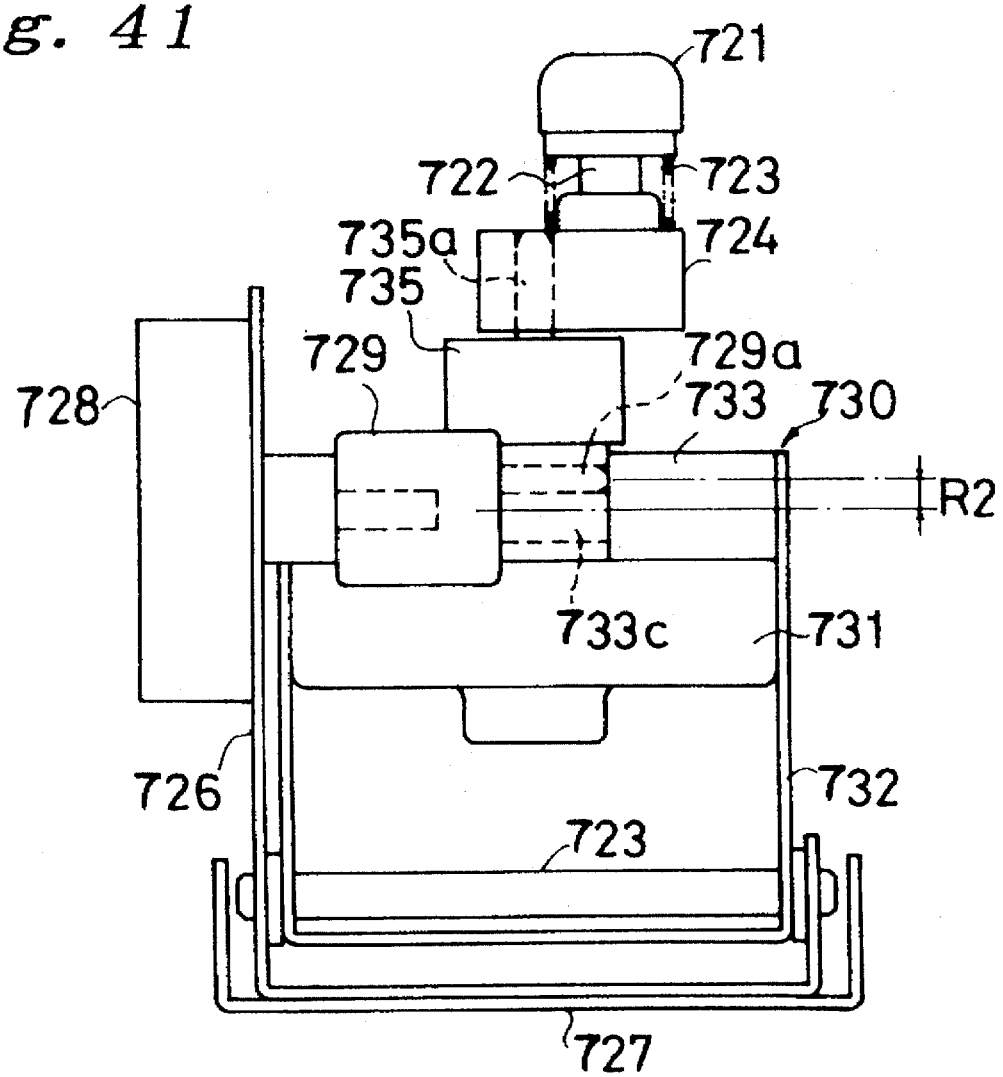
FIG. 41 is a side view of the massaging mechanism.

The detailed construction of the massaging mechanism 720 is described referring FIGS. 39–41. The massaging mechanism 720 comprises a base 727, a side plate 728 fixedly connected with the base 727 and a rotational drive device 730 which is swingably connected to the side plate 726 via a pivot axle 723. A reciprocation drive motor 728 is mounted on the side plate 726.

The rotational drive device 730 comprises a rotational drive motor 731, a support frame 732, a motor support 733, a boss 734 and a pair of first crank members 735.

The support frame 732 has a U-shaped construction in which the motor support 733 is fixedly mounted. The pivot axle 723 is placed penetrating the side plates 726 to swingably support the support frame 732 by the side plate 726.

The rotational drive motor 731 is mounted on the motor support 733. A rotational axle 731a of the motor 731 extends upward through a hole 733*a* of the motor support 733. The motor support 733 has a side projecting portion 733*b* having a slot 733*c*.

The boss 734 is fixedly attached to the rotational axle 731*a*. An upper support axle 734*a* is formed on the upper surface of the boss 734. The axis of the upper support axle 734*a* is eccentric from the axis of the rotational axle 731*a* by a distance "R1".

The upper support axle 734*a* is loosely fitted into a support hole 724*a* of a pressing member support 724. Another two support holes 724*b* are also formed in the pressing member support 724. Upper support axles 735*a* of the first crank members 735 are loosely fitted into the support holes 724*b*.

Lower support axles 735*b* are formed on the bottom surface of the first crank members 735. The lower support axles 735*b* are respectively eccentric from the upper support axles 735*a* by a distance "R1" and are loosely inserted into support holes 738*d* of the motor support 733.

In the rotational driving device 730 as constructed above, when the rotational drive motor 731 is driven, the pressing member support 724 is moved along a circular locus to move the pressing member along the same locus.

A swing axle 729*a* of a second crank member 729 is loosely inserted into the slot 733*c*. The second crank member 729 is fixedly connected with an output axle of the reciprocation drive motor 728. The axis of the swing axle 729*a* is eccentric from the axis of the output axle of the motor 728 by a distance "R2".

When the reciprocation drive motor 728 is driven, the rotational drive device 730 is swung back and forth around the pivot axle 723 to move the pressing members 721 back and forth.

In the above massaging mechanism 720, when only the rotational drive motor 731 is driven, the pressing members 721 are moved along a circular locus. When only the reciprocation drive motor 728 is driven, the pressing members 721 are moved back and forth reciprocatingly.

When both the rotational drive motor 731 and the reciprocation drive motor 728 are driven simultaneously, the pressing members 721 can be moved to as to describe a locus of ellipse or figure "8" as described above.

The motors 731,728 are independently controlled their speeds to allow the motion along either an ellipse locus or a figure "8" locus. Further, the rotational direction of the motor 731 is independently controllable.

Figure 42:
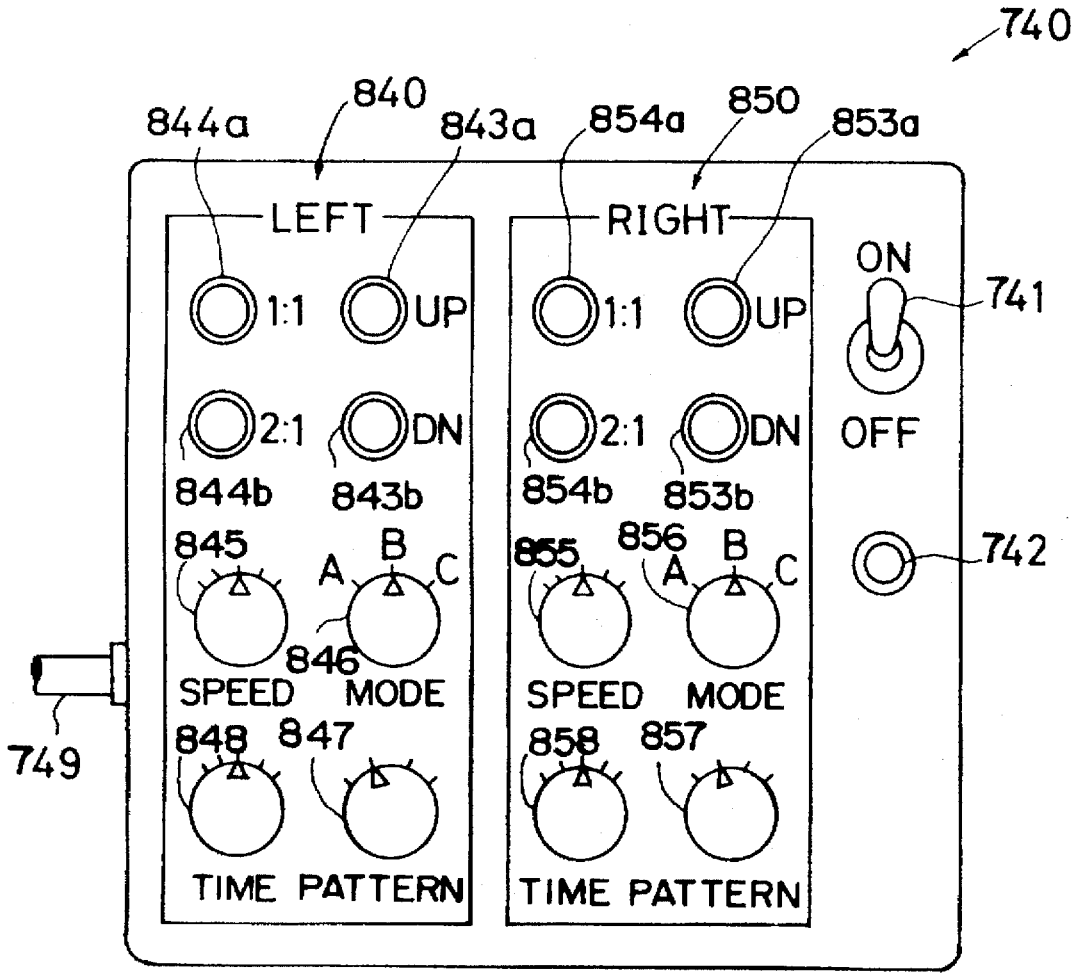
FIG. 42 is a plan view of the controller.

A controller 740 to control the motors is provided. The controller 740 comprises a remote control unit separately located from the support body 711 as shown in FIG. 42. The controller 740 is connected with the motors 731,728 through a control wire 749.

The controller 740 comprises a main switch 741, an operation indicating lamp 742, a left controlling unit 840 and a right controlling unit 850.

The main switch 741 controls the electric power supply. When it is turned on, the operation indicating lamp 742 is simultaneously turned on. Since the left and the right controlling units 840,850 have the same construction, only the left unit 840 is described here.

The left controlling unit 840 comprises projection adjusting buttons 843*a*,843*b*, speed ratio selection buttons 844*a*, 844*b*, a speed control knob 845, a mode selection knob 846, a pattern selection knob 847 and a timer knob 848.

The projection adjusting buttons 843*a*,843*b* are used to adjust the amount of outward projection of the pressing member 721. When the up-button 843*a* is pushed, the pressing member 721 is projecting outwardly. When the down-button 843*b* is pushed, it is retracted.

The speed ratio selection buttons 844*a*,844*b* are used to determine the speed ratio of the rotational drive motor 731 and the reciprocation drive motor 728. When the first button 844*a* is pushed, both the motors 731,728 are rotated at the same speeds to move the pressing member 721 along the ellipse locus. When the second button 844*b* is pushed, the speed ratio becomes 2:1 to move the pressing member 721 along the locus of figure "8".

The speed control knob 845 is used to control the rotational speeds of both the motors 731,728 and the rotational direction of the rotational drive motor 731. When it is turned right from a neutral position, both the motors 731,728 are rotated clockwise. When it is turned left from the neutral position, the rotational drive motor 731 is rotated counter-clockwise while the reciprocation drive motor 728 is rotated clockwise. The further it is turned right or left from the neutral position, the faster the motors 731,728 rotate.

Either A-mode, B-mode or C-mode can be selected by the mode selection knob 846. When the A-mode is selected, only the rotational drive motor 731 is driven to move the pressing members 721 along a circular locus. When the B-mode is selected, both the motors 731,728 are driven to move the pressing members 721 along the locus of ellipse or figure "8". When the C-mode is selected, only the reciprocation drive motor 728 is driven to move the pressing members 721 back and forth reciprocatingly.

Either a continuous drive pattern, an intermittent drive pattern, a reversible drive pattern or an intermittent-reversible drive pattern can be selected by the pattern selection knob 847.

Figure 43A:
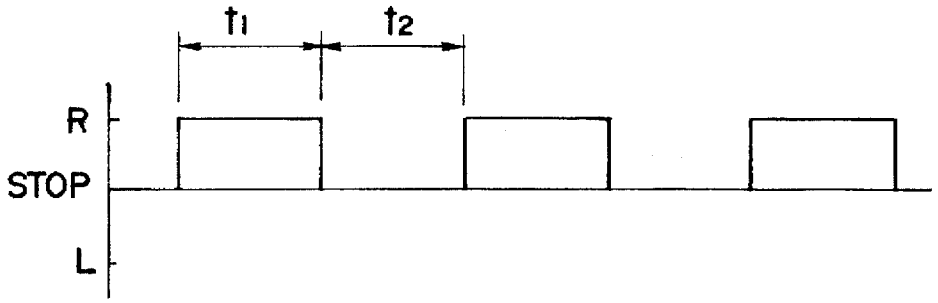
FIGS. 43A–43C are graphs to show various drive pattern.

When the continuous drive pattern is selected, both the motors 731,728 are driven continuously. When the intermittent drive pattern is selected, both the motors 731,728 are driven for t1 time (for example, for ten seconds) and then they are halted for t2 time (for example, for another ten seconds) as shown in FIG. 43A.

Figure 43B:
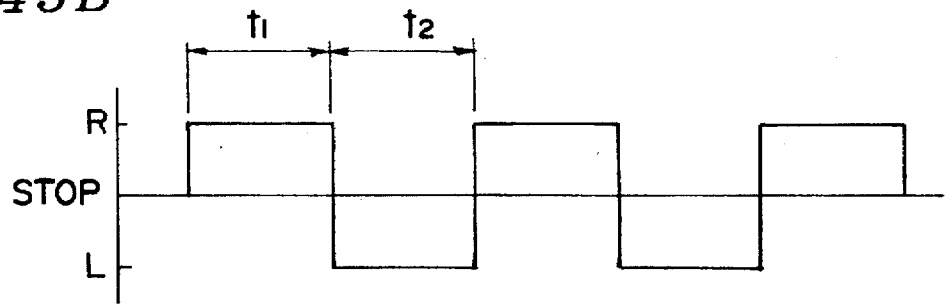
Figure 43C:
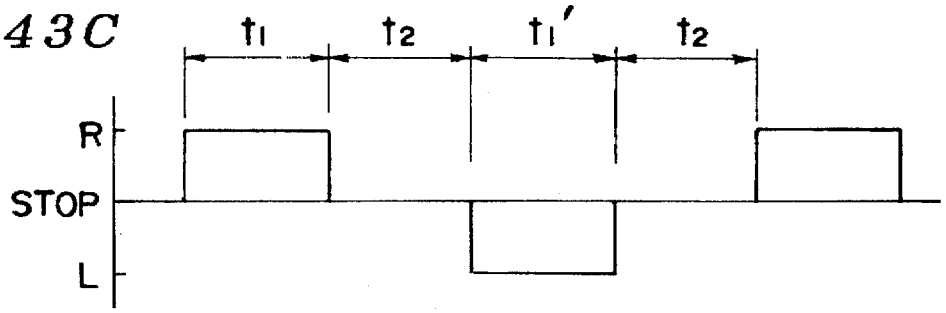

When the reversible drive pattern is selected, the rotational drive motor 731 is driven clockwise for t1 time and then it is driven counter-clockwise for t2 time as shown in FIG. 43B while the reciprocation drive motor 728 is kept driving. When the intermittent-reversible drive pattern is selected, the combination of the intermittent drive and the reversible drive is achieved as shown in FIG. 43C.

The above time t1,t2 can be adjusted by the timer knob 848 in the intermittent drive or the intermittent-reversible drive pattern. The driving time in the reversible drive pattern can also be adjusted by the timer knob 848.

Figure 44:
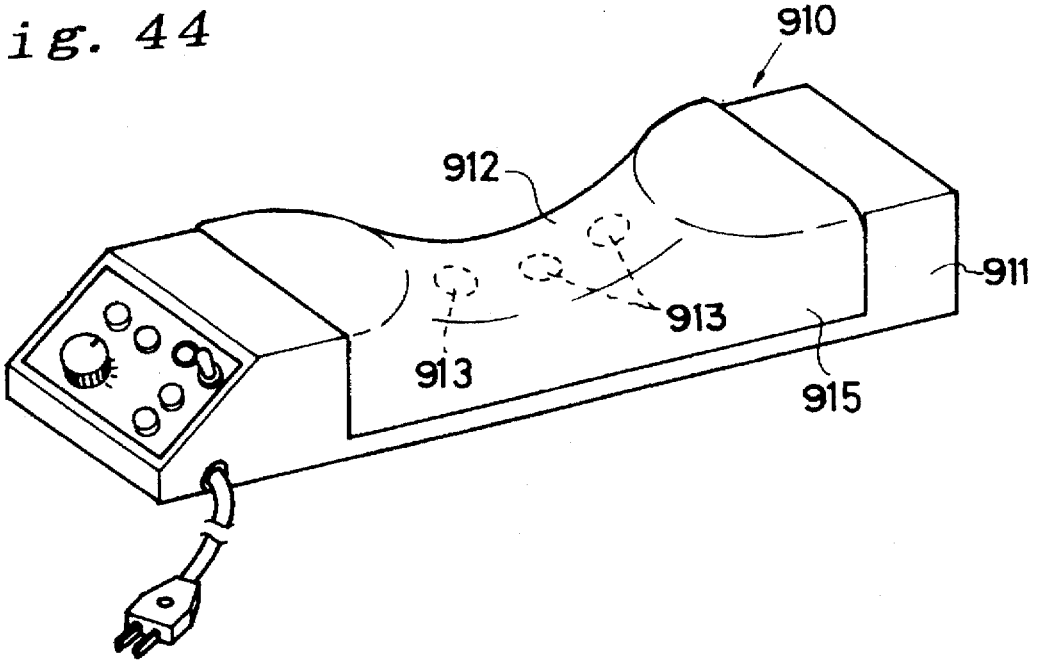
FIG. 44 is a perspective view of a different massaging apparatus.
Figure 45:
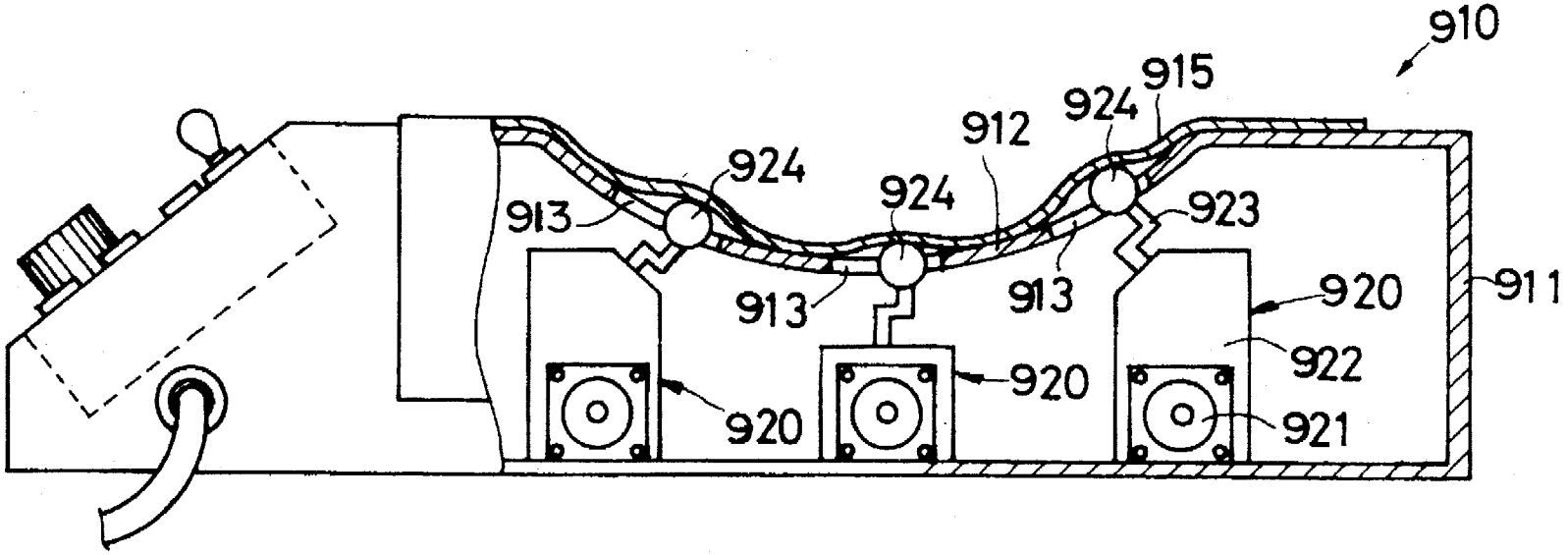
FIG. 45 is a cross-sectional view of the massaging apparatus.

An another massaging apparatus 910 according to the present invention is shown in FIGS. 44,45. The massaging apparatus 910 comprises a rectangular support body 911 with a curved recess 912. The top surface thereof is covered by a cloth cover 915.

Three massaging openings 913 are formed on the curved recess 912. Three massaging mechanisms 920 are placed inside the support body 911 so that each pressing member 924 partially project outward through the massaging opening 913.

The massaging mechanism 920 comprises an electric motor 921, a speed reducing device 922 to reduce the motor speed, a rotational axle 923 which is rotated by the motor 921 transmitted through the speed reducing device 922, and the pressing member 924 mounted on the tip end of the rotational axle 923.

The rotational axle 923 has a crank-shape. The upper axis "A" of the axle 923 is eccentric from the lower axis "B" of the axle 923 by a distance "g". When the axle 923 is rotated around the axis "A", the pressing member 924 (having the axis "B") is moved transversely along a circular locus with a radius "g".

Figure 46:
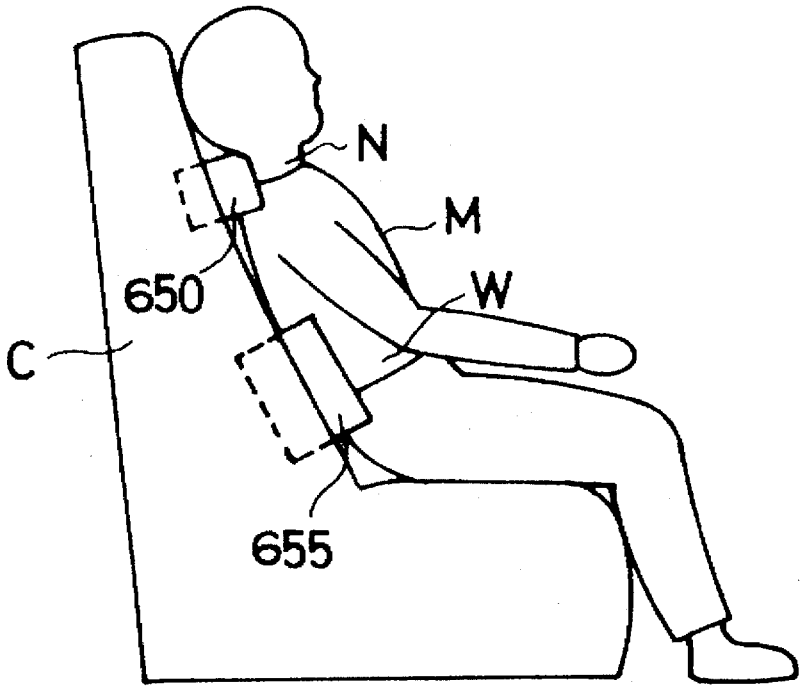

In the above embodiments, the massaging apparatuses are used to massage a neck portion of a patient. However, the massaging apparatus according to the present invention can be constructed to massage other portion of the human body. For example, as shown in FIG. 46, a massaging chair C having a neck massager 150 and a waist massager 155 can be used.

What is claimed is:

1. A massaging apparatus comprising:

a support body for supporting a body portion;

a pair of massaging openings formed in said support body for alignment with respective specific locations of the body portion to be massaged when the body portion is placed on said support body;

a pair of massaging mechanisms having respective pressing members with respective upper ends;

means mounting respective massaging mechanisms in said support body with respective upper ends thereof projecting outward through respective massaging openings;

transverse moving means for moving said pressing members along respective paths describing one of an ellipse and a FIG. 8; and, means for controlling transverse movements of said pressing members by said transverse moving means independently of each other.

2. A massaging apparatus according to claim 1, wherein said transverse moving means comprises:

a rotational member connected to said pressing member, a rotational axis of said rotational member being eccentric from a rotational axis of said pressing member;

a rotational drive device for rotating said rotational member about its rotational axis;

a reciprocating member mounted for back and forth movement;

means mounting said rotational drive device on said reciprocating member; and a reciprocative drive device for moving said reciprocating member back and forth.

3. A massaging apparatus according to claim 2, including a controller for controlling operations of said rotational drive device and said reciprocative drive device which move said pressing member transversely.

4. A massaging apparatus according to claim 3, wherein said controller operates said rotational drive device and said reciprocative drive device synchronously at the same speed so that movement of said pressing member describes an ellipse locus.

5. A massaging apparatus according to claim 3, wherein said controller operates said rotational drive device and said reciprocative drive device at a speed ratio of 2:1 so that movement of said pressing member describes a locus of figure "8".

6. A massaging apparatus according to claim 3, wherein said controller can select one of an A-mode in which only said rotational drive device is operated, a B-mode in which both said rotational drive device and said reciprocative drive device are operated, and a C-mode in which only said reciprocative drive device is operated.

7. A massaging apparatus according to claim 3, wherein said controller can select one of a continuous drive pattern, an intermittent drive pattern, a reversible drive pattern, and an intermittent-reversible drive pattern.

8. A massaging apparatus according to claim 1, wherein said transverse moving means comprises;

a rotational member connected to said pressing member, a rotational axis of said rotational member being eccentric from a rotational axis of said pressing member;

a rotational drive device for rotating said rotational member about its rotational axis;

a swingable member;

axle means pivotally mounting said swingable member on said support body for back and forth swinging movement;

means mounting said rotational drive device on said swingable member; and a swing drive device for swinging said swingable member back and forth about the axle means relative to said support body.

9. A massaging apparatus according to claim 8, including a controller for controlling operations of said rotational drive device and said reciprocating drive device which move said pressing member transversely.

10. A massaging apparatus according to claim 8, wherein said controller operates said rotational drive device and said reciprocative drive device synchronously at the same speed so that movement of said pressing member describes an ellipse locus.

11. A massaging apparatus according to claim 8, wherein said controller operates said rotational drive device and said reciprocative drive device at a speed ratio of 2:1 so that movement of said pressing member describes a locus of figure "8".

12. A massaging apparatus according to claim 8, wherein said controller can select one of an A-mode in which only said rotational drive device is operated, a B-mode in which both said rotational drive device and said reciprocating drive device are operated, and a C-mode in which only said reciprocative drive device is operated.

13. A massaging apparatus according to claim 8, wherein said controller can select one of a continuous drive pattern, an intermittent drive pattern, a reversible drive pattern, and an intermittent-reversible drive pattern.

14. A massaging apparatus according to claim 1, wherein said transverse moving means comprises;

a rotational member connected to said pressing member, a rotational axis of said rotational member being eccentric from a rotational axis of said pressing member; and a rotational drive device for rotating said rotational member around its rotational axis.

15. A massaging apparatus comprising:

a support body for supporting a body portion;

at least one massaging opening formed on said support body for alignment with a specific location of the body portion to be massaged when the body portion is placed on said support body;

a massaging mechanism comprising at least one pressing member having an upper end and transverse moving means for moving said pressing member along a path describing one of an ellipse and a FIG. 8; and, means mounting the massaging mechanism in said support body with said upper end of said pressing member projecting outward through said massaging opening for pressing and massaging engagement with the specific location of the body portion on the support body while being moved by the transverse moving means so that the pressing member moves across the specific location along a path transverse of a pressing direction describing one of an ellipse and a figure of 8: wherein said moving means comprises an elliptical motion producing mechanism which comprises:

a base;

a rotational member support swingably mounted on said base;

a cam member rotatively mounted on said rotational member support and connected to said pressing member and having a rotational axis eccentric from a rotational axis of said pressing member;

a cam follower fixed to said base and having an internal cam following surface;

means maintaining said cam member in contact with the cam following surface; and, a rotational drive device for rotating said cam member, so that rotation of said cam member thereby, repeatedly swings said rotational member support back and forth with respect to said base and rotates the pressing member about the rotational axis of said cam member.

16. A massaging apparatus according to claim 15, including means for adjusting an amount by which said at least one pressing member projects outward through said massaging opening for adjusting a pressing force applied by the pressing member against the specific location.

17. A massaging apparatus according to claim 1 or 4, wherein said support body defines a neck supporting portion.

18. A massaging apparatus according to claim 15, wherein said support body defines a waist supporting portion.

* * * * *